US010266999B2

(12) United States Patent
Rothschild

(10) Patent No.: US 10,266,999 B2
(45) Date of Patent: Apr. 23, 2019

(54) SELF-DEPLOYING VEHICLE INTRUSION BARRIER

(71) Applicant: Eikon Corporation, Andover, MA (US)

(72) Inventor: Peter John Rothschild, Newton, MA (US)

(73) Assignee: Eikon Corporation, Andover, MA (US)

( * ) Notice: Subject to any disclaimer, the term of this patent is extended or adjusted under 35 U.S.C. 154(b) by 0 days.

(21) Appl. No.: 15/657,089

(22) Filed: Jul. 21, 2017

(65) Prior Publication Data

US 2018/0023263 A1 Jan. 25, 2018

Related U.S. Application Data

(60) Provisional application No. 62/365,711, filed on Jul. 22, 2016.

(51) Int. Cl.
*E01F 13/12* (2006.01)
*E01F 13/02* (2006.01)

(52) U.S. Cl.
CPC ..... *E01F 13/12* (2013.01); *E01F 13/02* (2013.01)

(58) Field of Classification Search
CPC ..... E01F 13/12; E01F 13/02; E01F 15/088; E01F 15/006; E01F 15/0492; E01F 15/086; E01F 15/146; E01F 15/143; E01F 15/141
See application file for complete search history.

(56) References Cited

U.S. PATENT DOCUMENTS 4,097,170 A * 6/1978 Dickinson ..... E01F 13/105 404/11
4,367,975 A * 1/1983 Tyers ..... E01F 13/04 404/11
4,923,327 A * 5/1990 Gorlov ..... E01F 13/046 404/6

(Continued)

FOREIGN PATENT DOCUMENTS

FR 2627200 A1 8/1989

OTHER PUBLICATIONS

International Search Report and Written Opinion for International Application No. PCT/US2017/043415, entitled: "Self-Deploying Vehicle Intrusion Barrier," dated Jan. 29, 2018.

*Primary Examiner* — Abigail A Risic
(74) *Attorney, Agent, or Firm* — Hamilton, Brook, Smith & Reynolds, P.C.

(57) ABSTRACT

A vehicle barrier apparatus includes a base and a deployable element. The deployable element is rotatably coupled to the base, enabling transition from a stored orientation to a deployed orientation. The deployable element can engage a vehicle physically in the deployed orientation to impair vehicle motion. An actuating mechanism is mechanically coupled to the deployable element cause the deployable element to move from the stored orientation to the deployed orientation responsive to a trigger. The apparatus may include a triggering device that detects the vehicle and provides the trigger to the actuating mechanism responsive to the detection. In addition, or alternatively, the apparatus can include a communications interface that receives a trigger communication from a remote location and causes the trigger to be provided to the actuating mechanism. The apparatus may be portable.

38 Claims, 24 Drawing Sheets

(56) References Cited

U.S. PATENT DOCUMENTS 5,248,215 A * 9/1993 Fladung ..... E01F 9/40 404/6
5,288,164 A * 2/1994 Nasatka ..... E01F 13/12 404/10
5,507,588 A * 4/1996 Marts ..... E01F 13/123 256/1
5,588,774 A * 12/1996 Behan ..... E01F 13/123 404/6
6,045,293 A * 4/2000 Dickinson ..... E01F 13/123 256/1
6,409,418 B1 * 6/2002 Blair ..... E01F 13/123 404/6
7,645,090 B2 * 1/2010 Rastegar ..... E01F 13/123 404/15
8,152,407 B1 * 4/2012 Al-Qahtani ..... E01F 13/12 404/6
8,439,594 B1 * 5/2013 Clark ..... E01F 13/12 256/13.1
8,439,595 B1 * 5/2013 Chaparro ..... E01F 13/12 340/12.1
9,771,696 B2 * 9/2017 Neusch ..... E01F 13/08
2006/0078378 A1 4/2006 Burns et al.
2006/0233607 A1 10/2006 Buckley et al.
2007/0048083 A1 * 3/2007 Burns ..... E01F 13/046 404/6
2010/0196093 A1 8/2010 Seeglitz et al.
2012/0282024 A1 * 11/2012 Hua ..... E01F 9/529 404/15
2013/0045047 A1 * 2/2013 Morgan ..... E01F 13/08 404/6
2014/0234024 A1 * 8/2014 Brackin ..... E01F 13/08 404/6
2016/0054102 A1 * 2/2016 Maydew ..... E01F 13/12 256/25
2017/0130411 A1 * 5/2017 Price ..... E01F 13/12

* cited by examiner

SELF-DEPLOYING VEHICLE INTRUSION BARRIER

RELATED APPLICATION

This application claims the benefit of U.S. Provisional Application No. 62/365,711, filed on Jul. 22, 2016. The entire teachings of the above application are incorporated herein by reference.

BACKGROUND

Security barriers may be installed around buildings, walkways, and other locations to prevent intrusion of vehicles that may pose a threat. Potential threats may include vehicles such as trucks laden with bombs, suicide bombers intending to attack security checkpoints, and other vehicles being directed to targets for terrorist purposes. Existing vehicle barriers include retractable metal spikes installed in pavement, large concrete blocks or stones place around buildings, concrete barriers that may be lifted into place by a crane beside roadways and venues, and metal posts bored into sidewalks and streets.

SUMMARY

Existing barriers are inadequate to address today's terrorist threats and other security concerns. For example, at the 2016 Bastille Day event in Nice, France, a terrorist drove a large truck for over a mile through a crowded boardwalk, killing 84 people during the celebrations. Further attacks have taken place more recently in London, England. There is an urgent need for a simple, low maintenance, easily deployable, and noninvasive barrier that can prevent vehicular access to certain areas. The intrusion barriers that are currently available do not self-deploy and tend to be devices that are designed to withstand tremendous forces in order to stop a vehicle. They are typically built into the roadway. Because extensive site modifications are required, this limits where and when the barriers can be installed. They tend to be intrusive and expensive, and they cannot be place in venues of interest rapidly for special events or security situations.

Embodiments described herein can address the foregoing deficiencies, being rapidly and easily placed, as well as being capable of disabling vehicles, thereby preventing vehicles from entering restricted areas. Vehicle barrier apparatuses and systems disclosed herein may be much smaller and lighter than existing barriers. Disclosed embodiments may also be less costly and avoid any need for site modifications to prepare for placement of the apparatus. Embodiments may be deployed or removed in a few minutes. Disclosed embodiments may require no maintenance or supervision, yet still provide the ability to rapidly and safely disable trucks and other vehicles.

An embodiment described herein is a simple and reliable mechanical barrier that can be easily and rapidly placed in urban areas. Certain embodiments may lie flat on a roadway or other surface over which pedestrians or vehicles can travel, such as a sidewalk. For many embodiments, no site preparation is required prior to placement, and embodiment barriers need not be anchored to an underlying surface, although this is an option.

Some embodiments described herein have a low profile in an un-triggered state (stored orientation), such as only about 4 inches high in the un-triggered state. Many embodiments may be self-deployed automatically, in that they can be deployed in response to a presence of a vehicle without human intervention. Embodiments can detect weight or the forward momentum of a vehicle (for example, a truck or car) to trigger activation of a barrier designed to effectively impede forward motion of the vehicle. In some embodiments, detection of the presence of the vehicle is by a trigger device in the apparatus responding to weight or forward momentum of a vehicle, such as by means of a weight- or momentum-sensitive latch or a weight- or momentum-sensitive shear pin. However, detection of the presence of a vehicle may include use of active means, such as force sensors or other vehicle detection technologies.

For areas where only cars are allowed, but no trucks are allowed, vehicle barriers disclosed herein can be configured to activate only when a truck crosses them, yet remain un-triggered when smaller vehicles, carts, other items, or persons pass over them. For certain areas, where no vehicles are ever allowed (for example, sidewalks or other pedestrian-only areas), embodiments placed in the area can be triggered to be deployed when any vehicle drives over them, at slow or fast speeds.

Embodiments can even be purely mechanical, contain no electrical components, and require no batteries, power, or regular maintenance.

In one embodiment, a vehicle barrier apparatus includes a base and a deployable element that is rotatably coupled to the base. A rotatable mechanical coupling enables a transition from a stored orientation to a deployed orientation. The deployable element is configured, in the deployed orientation, to engage a vehicle physically to impair motion of the vehicle. The apparatus further includes an actuating mechanism mechanically coupled to the deployable element. The actuating mechanism is configured to cause the deployable element to move from the stored orientation to the deployed orientation in response to a trigger. The apparatus further includes a triggering device operably coupled to the actuating mechanism and configured to detect a presence of the vehicle and to provide the trigger to the actuating mechanism responsive to detecting a presence of the vehicle.

The deployable element may have a base end and a vehicle engagement end, the deployable element being rotatably coupled to the base at the base end. The vehicle engagement end may be configured in the deployed orientation to engage the vehicle physically to impair motion of the vehicle. The actuating mechanism may be configured to cause the deployable element to rotate from the stored orientation to the deployed orientation.

The base may include one or more ramps configured to facilitate a smooth transition of travel for the vehicle onto or off of the vehicle barrier apparatus with the deployable element in the stored orientation. The deployable element may fit inside a cavity defined by the base such that, in the stored orientation, a profile of the apparatus is essentially the same as a profile of the base. The base may include one or more rollers configurable to facilitate lateral movement of the apparatus to aid in placement and installation.

The base, or another portion of the apparatus, may be configured to be permanently or removably fastened to a surface, or below a surface, of a road or sidewalk. The base, or another portion of the apparatus, may include one or more interlocking elements configured to attach the base, or other portion of the apparatus, of the first vehicle barrier apparatus to one or more corresponding bases, or one or more other corresponding portions, of one or more respective second vehicle barrier apparatuses.

The base may have a length or width in a range of about 1 foot to about 12 feet, or 1 foot to about 6 feet (e.g., about 4 feet). The base may have a profile height in a range of about 2-6 inches or 2-12 inches (e.g., about 4 inches).

The deployable element may have a continuous face spanning an entirety of lateral dimensions from the base end to the vehicle interface end. Alternatively, the deployable element may include one or more struts, wherein, in the case of more than one strut, the struts: (i) have a common axis of rotation and a common direction of rotation; or (ii) have at least two axes of rotation and at least two corresponding directions of rotation; or (iii) have at least two axes of rotation and at least two corresponding directions of rotation, and wherein struts with a first axis of the axes of rotation are arranged to be interdigitated with struts with a second axis of the axes of rotation.

The vehicle engagement end of the deployable element may include one or more pointed tips configured to puncture one or more tires of the vehicle, with the deployable element in the deployed orientation, to impair the motion of the vehicle. The deployable element may be further configured to impair motion of the vehicle by mechanically coupling the vehicle to the base, wherein the base has friction with the ground. The deployable element may be configured to be below a surface of a street or sidewalk in the stored orientation, and the vehicle engagement end may be configured to be above the surface in the deployed orientation.

The deployable element and the base may be coupled to respective portions of a bracket. The bracket may be configured to be folded while the deployable element is in the stored orientation. The deployable element may be configured to be unfolded and locked when the deployable element is in the deployed orientation. A rotation of the deployable element with respect to the base may be limited by a cable with the deployable element in the deployed orientation. The cable may be attached to the base and to the deployable element either at the vehicle engagement end or between the base end and the vehicle engagement end.

The actuating mechanism may include one or more springs configured to cause the deployable element to rotate from the stored orientation to the deployed orientation using stored spring power. The actuating mechanism may include a rocker configured to rotate the deployable element from the stored orientation to the deployed orientation using at least one of a weight and a momentum of the vehicle. The actuating mechanism may be configured to rotate the deployable element from the stored orientation to the deployed orientation using at least one of pneumatic power, hydraulic power, and electrical power. The actuating mechanism may be configured to cause the deployable element to rotate from the stored orientation to the deployed orientation within about 10-100 ms.

The triggering device may include at least one latch configured to provide the trigger in response to at least one of a weight and momentum of the vehicle. The triggering device can include one or more shear pins configured to be sheared in response to at least one of a weight and momentum of the vehicle. The shear pins may be obscured by a ramp from viewing by a vehicle, driver, pedestrian, or camera. The triggering device may include a force sensor. The force sensor may be installed in or on a road or sidewalk physically separated from the base. The triggering device may be configured to discriminate between vehicles and other objects or persons to provide the trigger to the actuating mechanism responsive to detecting the presence of the vehicle but not responsive to detecting a presence of the other objects or persons. The triggering device may be further configured to discriminate on the basis of vehicle size by providing the trigger responsive to detecting the presence of a relatively larger vehicle and to not provide the trigger responsive to detecting the presence of a relatively smaller vehicle.

The base and triggering device may comprise the same element. The actuating mechanism may be a rocker rib configured to mechanically support the deployable element and to rotate the deployable element from the stored orientation to the deployed orientation responsive to a wheel of the vehicle contacting the base and triggering device.

The apparatus may further include a handling adapter configured to be mechanically coupled to the apparatus directly or indirectly. The handling adapter may be further configured to facilitate handling of the vehicle barrier apparatus by at least one of a forklift, crane, cart, or winch.

The apparatus may further include a deactivating mechanism configured to prevent at least one of: the triggering device from providing the trigger, the actuating mechanism from responding to the trigger, and the deployable element from deploying responsive to the actuating mechanism. The apparatus may further include a manual activating mechanism configured to enable the deployable element to be set to the deployed orientation in response to a manual setting.

The apparatus may further include a communications interface operably coupled to the actuating mechanism, the communications interface being configured to receive a trigger communication from a remote location and to cause the trigger to be provided to the actuating mechanism responsive to the trigger communication. The apparatus may further include a communications interface operably coupled to the actuating mechanism. The communications interface may be configured to transmit a status indicator, which may include a state of the deployable element. The apparatus may further include a communications interface operably coupled to the actuating mechanism and configured to prevent, in response to a communication received at the communications interface from a remote location, the triggering device from providing the trigger to the actuating mechanism.

In another embodiment, a vehicle barrier apparatus includes a portable base and a deployable element. The deployable element is rotatably coupled to the base to enable a transition from a stored orientation to a deployed orientation. The deployable element is configured, in the deployed orientation, to engage a vehicle physically to impair motion of the vehicle. The apparatus also includes an actuating mechanism mechanically coupled to the deployable element and configured to cause the deployable element to move from the stored orientation to the deployed orientation in response to a trigger. The apparatus further includes a communications interface operably coupled to the actuating mechanism. The communications interface is configured to receive a trigger communication from a remote location and to cause the trigger to be provided to the actuating mechanism responsive to the trigger communication.

The deployable element may have a base end and a vehicle engagement end, the deployable element being rotatably coupled to the base at the base end. The vehicle engagement end may be configured in the deployed orientation to engage the vehicle physically to impair motion of the vehicle. The actuating mechanism may be configured to cause the deployable element to rotate from the stored orientation to the deployed orientation.

The base may include one or more ramps configured to facilitate a smooth transition of travel for the vehicle onto or off of the vehicle barrier apparatus with the deployable element in the stored orientation. The deployable element may fit inside a cavity defined by the base such that, in the stored orientation, a profile of the apparatus is essentially the same as a profile of the base. The base may include one or more rollers configurable to facilitate lateral movement of the apparatus to aid in placement and installation.

The base, or another portion of the apparatus, may be configured to be permanently or removably fastened to a surface, or below a surface, of a road or sidewalk. The base, or another portion of the apparatus, may include one or more interlocking elements configured to attach the base, or other portion of the apparatus, of the first vehicle barrier apparatus to one or more corresponding bases, or one or more other corresponding portions, of one or more respective second vehicle barrier apparatuses. The base may have a length or width in a range of about 1 foot to about 6 feet (e.g., about 4 feet). The base may have a profile height in a range of about 2-6 inches (e.g., about 4 inches).

The deployable element may have a continuous face spanning an entirety of lateral dimensions from the base end to the vehicle interface end. The deployable element may include one or more struts, wherein, in the case of more than one strut, the struts: (i) have a common axis of rotation and a common direction of rotation; or (ii) have at least two axes of rotation and at least two corresponding directions of rotation; or (iii) have at least two axes of rotation and at least two corresponding directions of rotation, and wherein struts with a first axis of the axes of rotation are arranged to be interdigitated with struts with a second axis of the axes of rotation.

The vehicle engagement end of the deployable element may include one or more pointed tips configured to puncture one or more tires of the vehicle, with the deployable element in the deployed orientation, to impair the motion of the vehicle. The deployable element may be further configured to impair motion of the vehicle by mechanically coupling the vehicle to the base, wherein the base has friction with the ground. The deployable element may be configured to be below a surface of a street or sidewalk in the stored orientation, and the vehicle engagement end may be configured to be above the surface in the deployed orientation.

The deployable element and the base may be coupled to respective portions of a bracket. The bracket may be configured to be folded while the deployable element is in the stored orientation. The deployable element may be configured to be unfolded and locked when the deployable element is in the deployed orientation. A rotation of the deployable element with respect to the base may be limited by a cable with the deployable element in the deployed orientation. The cable may be attached to the base and to the deployable element either at the vehicle engagement end or between the base end and the vehicle engagement end.

The actuating mechanism may include one or more springs configured to cause the deployable element to rotate from the stored orientation to the deployed orientation using stored spring power. The actuating mechanism may include a rocker configured to rotate the deployable element from the stored orientation to the deployed orientation using at least one of a weight and a momentum of the vehicle. The actuating mechanism may be configured to rotate the deployable element from the stored orientation to the deployed orientation using at least one of pneumatic power, hydraulic power, and electrical power. The actuating mechanism may be configured to cause the deployable element to rotate from the stored orientation to the deployed orientation within about 10-100 ms.

The apparatus may further include a triggering device operably coupled to the actuating mechanism and configured to detect a presence of the vehicle and to provide the trigger to the actuating mechanism responsive to detecting a presence of the vehicle. The triggering device may include at least one latch configured to provide the trigger in response to at least one of a weight and momentum of the vehicle. The triggering device can include one or more shear pins configured to be sheared in response to at least one of a weight and momentum of the vehicle. The shear pins may be obscured by a ramp from viewing. The triggering device may include a force sensor. The force sensor may be installed in or on a road or sidewalk physically separated from the base. The triggering device may be configured to discriminate between vehicles and other objects or persons to provide the trigger to the actuating mechanism responsive to detecting the presence of the vehicle but not responsive to detecting a presence of the other objects or persons. The triggering device may be further configured to discriminate on the basis of vehicle size by providing the trigger responsive to detecting the presence of a relatively larger vehicle and to not provide the trigger responsive to detecting the presence of a relatively smaller vehicle.

The base and triggering device may comprise the same element. The actuating mechanism may be a rocker rib configured to mechanically support the deployable element and to rotate the deployable element from the stored orientation to the deployed orientation responsive to a wheel of the vehicle contacting the base and triggering device.

The apparatus may further include a handling adapter configured to be mechanically coupled to the apparatus, such as to the base, directly or indirectly. The handling adapter may be further configured to facilitate handling of the vehicle barrier apparatus by at least one of a forklift, crane, cart, or winch.

The apparatus may further include a deactivating mechanism configured to prevent at least one of: the triggering device from providing the trigger, the actuating mechanism from responding to the trigger, and the deployable element from deploying. The apparatus may further include a manual activating mechanism configured to enable the deployable element to be set to the deployed orientation in response to a manual setting.

The communications interface may be further configured to transmit a status indicator including a state of the deployable element. The communications interface may be further configured to prevent, in response to a communication received at the communications interface from the remote location, the triggering device from providing the trigger to the actuating mechanism.

In yet another embodiment, a vehicle barrier apparatus includes means for rotatably coupling a deployable element to a base, the deployable element including a base end and a vehicle engagement end. The means for rotatably coupling enables a transition of the deployable element from a stored orientation to a deployed orientation. The vehicle engagement end is configured in the deployed orientation to engage a vehicle physically to impair motion of the vehicle. The apparatus also includes means for causing the deployable element to rotate from the stored orientation to the deployed orientation in response to a trigger. The apparatus still further includes means for detecting a presence of the vehicle and for providing the trigger responsive to detecting a presence of the vehicle.

In still a further embodiment, a vehicle barrier apparatus includes means for rotatably coupling a deployable element to a portable base. The deployable element includes a base end and a vehicle engagement end. The means for rotatably coupling enables a transition of the deployable element from a stored orientation to a deployed orientation. The vehicle engagement end is configured, in the deployed orientation, to engage a vehicle physically to impair motion of the vehicle. The apparatus also includes means for causing the deployable element to rotate from the stored orientation to the deployed orientation in response to a trigger. The apparatus still further includes means for receiving the trigger via a trigger communication from a remote location and for causing the trigger to be provided, responsive to the trigger communication, to the means for causing the deployable element to rotate.

Figure 1:
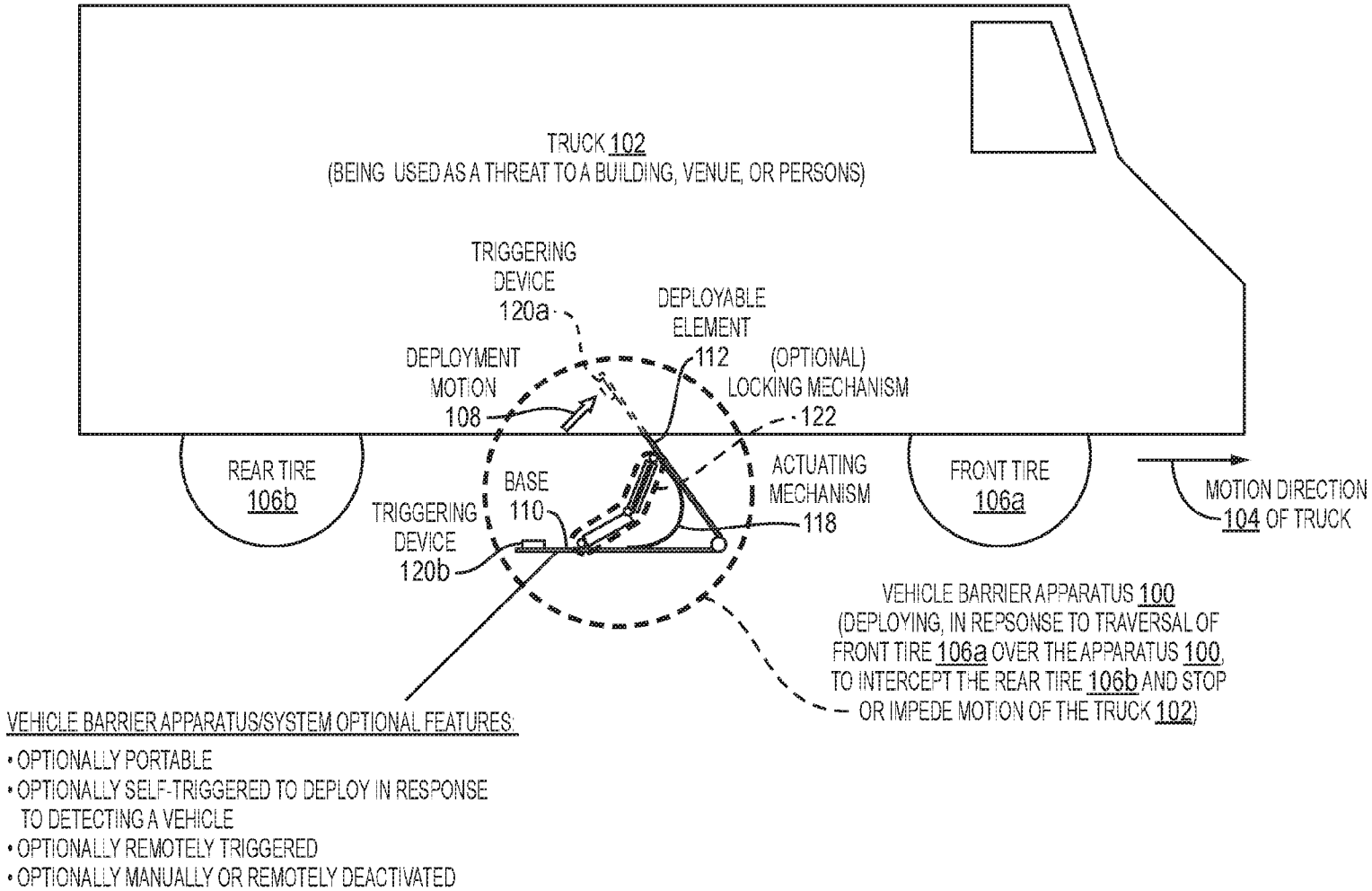
FIG. 1 is a side-view illustration of an embodiment vehicle barrier apparatus deploying in response to traversal of a truck's front tire.

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

In general, many vehicle barrier embodiments disclosed herein include a base, a deployable element, an actuating mechanism, and a triggering device. The deployable element includes a base end that is rotatably coupled to the base to enable a transition of the deployable element from a stored orientation to a deployed orientation. The deployable element also includes a vehicle engagement end that is configured, in the deployed orientation, to engage a vehicle physically to impair motion of the vehicle. These elements, together with certain optional elements, are exemplified in the embodiments illustrated in FIGS. 1 and 2A-2C.

In some embodiments, such as the apparatus described in connection with FIG. 3, impairment of the motion of the vehicle may occur by means of one or more tire spikes situated at the vehicle engagement end of the deployable element. In addition to tire spikes, such as those illustrated in FIGS. 2A-2C, the deployable element may impair motion of the vehicle through a mechanical coupling between the deployable element and the base, where the base is permanently or removably affixed to a surface on which the base stands, or wherein the base is not affixed, yet has friction with the surface on which it stands.

The mechanical coupling of the deployable element to the base may be principally by means of a hinge connecting the deployable element to the base. However, the mechanical coupling may also be additionally, or alternatively, by means of a locking bracket, such as that illustrated in FIGS. 2A-2C, a cable connecting the deployable element to the base, as described in connection with FIG. 3, or by other means described herein, or other means that would be understood by those skilled in the mechanical arts in view of this specification. In various embodiments, the deployable element may be maintained in a fixed, deployed orientation by means of a locking mechanism, such as a locking bracket, such as that described in connection with FIGS. 1, 2A-2C, 3, and 4A-4B, or a sliding bracket connecting the deployable element with the base and configured to engage with teeth in the base, such as that described in connection with FIGS. 11A-11B, for example.

The actuating mechanism is mechanically coupled to the deployable elements and is configured to cause the deployable element to rotate from the stored orientation to the deployed orientation in response to a trigger. The actuating mechanism may include one or more springs, such as those illustrated in FIGS. 2A-2C and 11A-11B, for example. However, in other embodiments, the actuating mechanism uses at least one of pneumatic power, hydraulic power, and electrical power to rotate the deployable element from the stored orientation to the deployed orientation. Furthermore, in some embodiments, such as that described in connection with FIGS. 13A-13C, 14A-14B, and 15A-15D, the actuating mechanism may include a combination of other elements of the apparatus, acting in concert with at least one of weight and momentum of an impinging vehicle.

Many embodiments also include a triggering mechanism configured to detect a presence of the vehicle and provide the trigger to the actuating mechanism, as described further hereinafter. In some embodiments, such as those illustrated in FIGS. 10A-10B and 16A-16B, the apparatus is self-triggering, in that the trigger, whether mechanical, electromechanical, or otherwise, is self-contained in the apparatus and detects the presence of the vehicle and responds to the detected presence to provide the trigger to the actuating mechanism. In other embodiments, such as the system illustrated in FIG. 23, detection of the vehicle's presence is by means of a force sensor or other component external to the apparatus, and the apparatus includes a communication interface for receiving a signal (trigger communication) from the external component. In system embodiments such as the one illustrated in FIG. 23, the apparatus may include an electromechanical mechanism, such as an electromechanical latch, that is configured to respond to the trigger communication directly or indirectly to complete the triggering process.

In embodiments including a purely mechanical triggering device, "providing the trigger to the actuating mechanism," as used herein, can include unlatching the deployable element such that the actuating mechanism (e.g., spring) may act on the deployable element to rotate it from the stored orientation to the deployed orientation. In the example illustrated in FIGS. 16A-16B, for example, a combination of a sheer pin and a spring latch, together with other components, act as the actuating mechanism.

FIG. 1 is a side-view illustration of a vehicle barrier apparatus 100 deploying in response to traversal of a front tire 106*a* of a truck 102 over the apparatus. The truck 102 may be used by a terrorist or other criminal as a threat to a building, a venue, or persons, or the truck may be only a perceived threat to be stopped. As the truck proceeds in a motion direction 104, with the front tire 106*a* traversing over the apparatus 100, the apparatus 100 detects the truck 102 and deploys with a deployment motion 108 to intercept a rear tire 106*b* of the truck and to stop the truck.

In various embodiments, a vehicle barrier apparatus or system may be optionally portable and may be optionally self-triggered to deploy in response to detecting a vehicle. Additionally, or as an alternative, various embodiments may be configured to include a communications module that may trigger the apparatus to deploy in response to a triggering communication from a remote location. Various remote locations may include a security checkpoint, the location of a security officer carrying a remote control to communicate with the apparatus 100, a location where security camera video of a venue to be protected is being monitored, a location of a triggering force sensor installed in a road or sidewalk, etc. Furthermore, various vehicle barrier apparatus and system embodiments may be optionally manually or remotely deactivated, such that a vehicle may traverse the apparatus or system without triggering deployment of the apparatus.

Figure 2C:
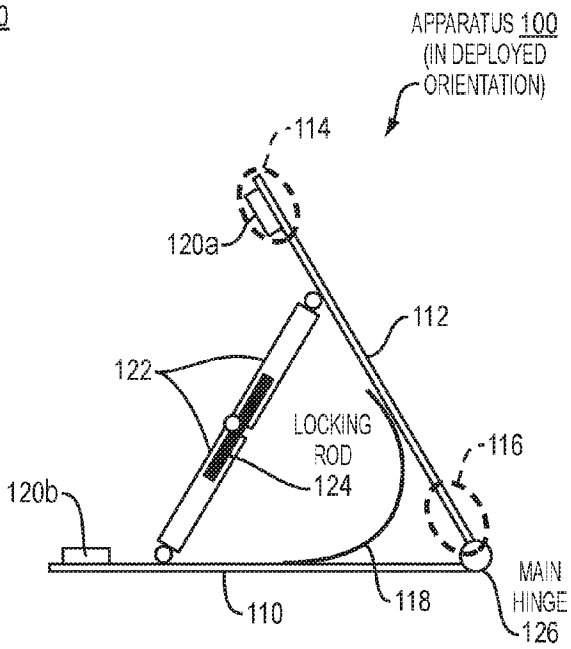
FIGS. 2A-2C illustrate particular features of the embodiment apparatus illustrated in FIG. 1, as well as various general and optional features of embodiment vehicle barrier apparatuses and systems.
Figure 2B:
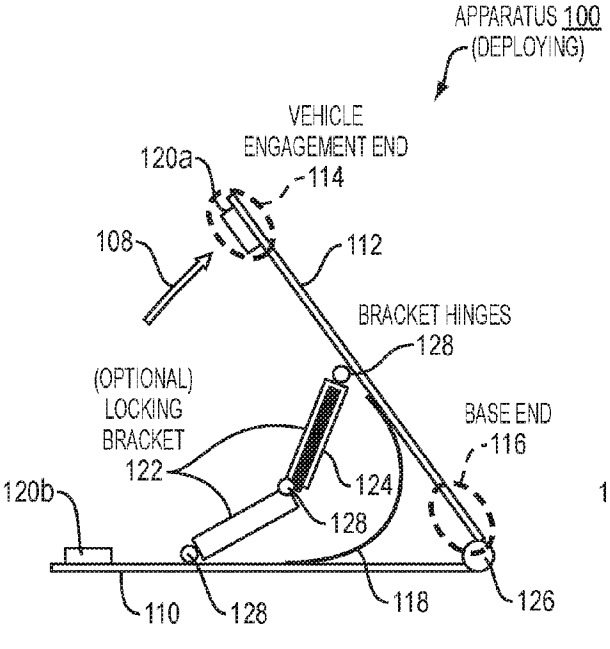
Figure 2A:
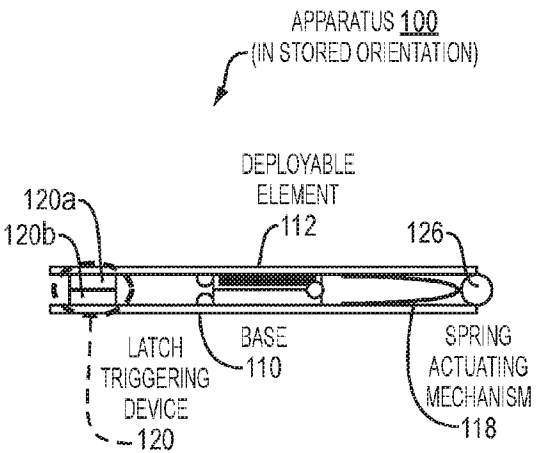

FIGS. 2A-2C illustrate the apparatus 100 in FIG. 1 in greater detail and also illustrate many of the general principles described hereinabove. In the apparatus 100, the base 110 is a rectangular plate configured to sit on a road or sidewalk surface. The deployable element 112 is also a rectangular plate with a shape that is substantially the same as the shape of the base 110. The actuating mechanism 118 is a spring that is configured to force the deployable element 112 to rotate with respect to the base to the deployed orientation when the latch 120 is released. FIG. 2A illustrates the apparatus 100 in the stored orientation, where it has not been triggered to deploy the deployable element. FIG. 2B illustrates the deployable element 112 partially deployed, and FIG. 2C illustrates the deployable element 112 fully deployed (in the fully deployed orientation).

As illustrated in FIG. 2B, the deployable element 112 includes a base end 116 that is coupled to the base 110, as well as a vehicle engagement end 114 that is configured to engage with an incoming vehicle. The base 110 and deployable element 112 are coupled by means of a main hinge 126 that couples the base end 116 to the base 110 and allows the deployable element 112 to rotate to the deployed orientation, using the power of the spring actuating mechanism 118, upon the latch triggering device becoming unlatched and, thus, triggering the spring 118 to cause the rotation.

FIGS. 2B-2C also illustrate that the apparatus 100 is held fixed in the deployed orientation by means of a locking bracket 122. The bracket 122 includes bracket hinges 128 that couple the bracket 122 to the base 110 and deployable element 112. The locking bracket 122 also includes a center bracket hinge 128 that allows upper and lower sections of the locking bracket to be folded in the stored orientation and to be rotatably moved to a locked orientation for the bracket, as illustrated in FIG. 2C. A locking rod 124, stored in the upper portion of the locking bracket 122 in the stored orientation, falls down through the locking bracket 122, which can be a hollow pipe or shaft, for example, when the element 112 is raised to the deployed orientation. In the deployed orientation, the locking rod 124 locks the two portions of the locking bracket 122 into a fixed orientation, preventing further rotational motion of the bracket 122 and deployable element 112. The locking bracket and rod are described further hereinafter in connection with FIGS. 4A-4B.

Figure 3:
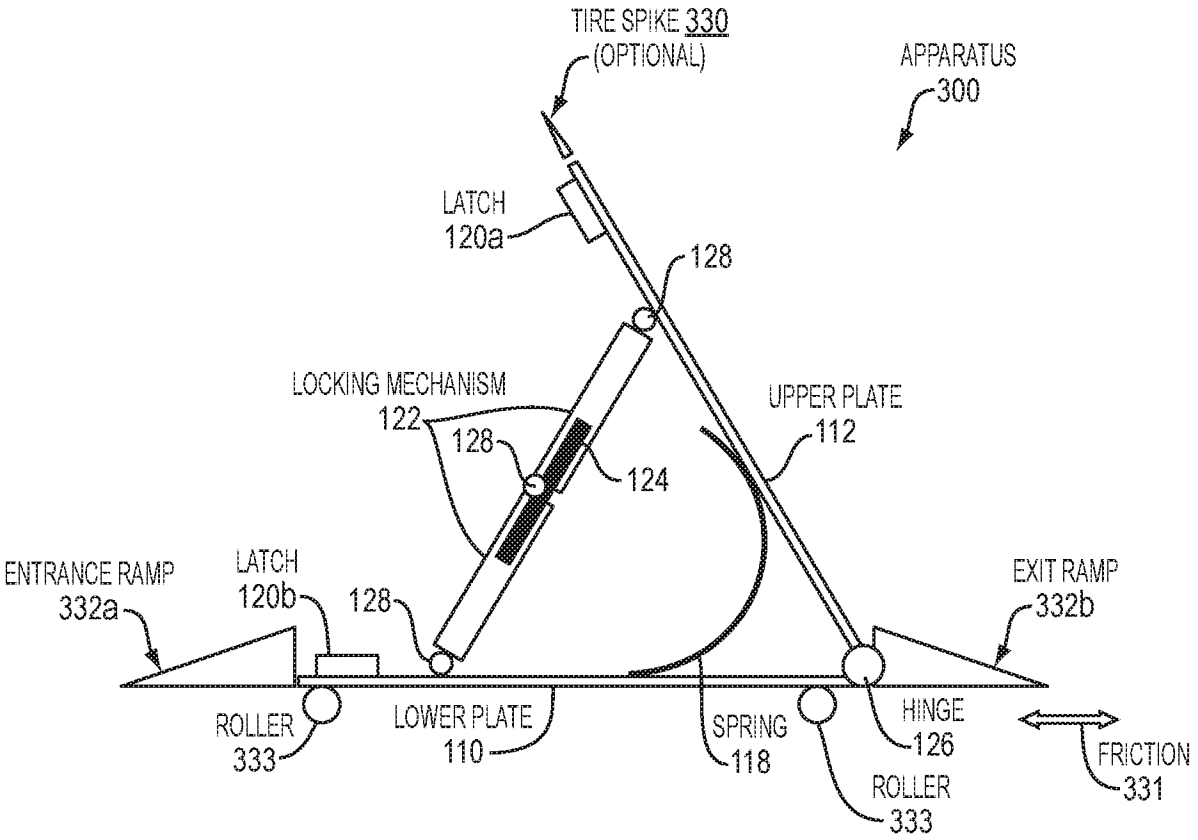
FIG. 3 is a profile-view illustration of an embodiment vehicle barrier apparatus including various optional features including a locking bracket, tire spikes, and ramps.

FIG. 3 is a profile view of a vehicle barrier apparatus 300. The apparatus 300 is similar in many respects to the apparatus 100 illustrated in FIGS. 2A-2C and shows the apparatus 300 in the fully deployed orientation. The apparatus 300 differs from the apparatus 100 in that the apparatus 300 includes one or more tire spikes 330 at the vehicle engagement end of the deployable element 112. The spikes 330 are configured to puncture tires of an incoming vehicle to inhibit motion of the vehicle. The puncturing may be in addition to inhibiting motion of the incoming vehicle by means of coupling the deployable element 112 to the base 110, which has friction with the pavement or sidewalk on which it stands.

Further in FIG. 3, the apparatus 300 includes an entrance ramp 332*a* and exit ramp 332*b*, which are part of the base together with the lower plate 110, which is the base in the apparatus 100. The ramps 332*a-b* are configured to facilitate a smooth transition of travel for a vehicle onto and off of the apparatus 300 when the apparatus is in the stored orientation. These ramps may also facilitate smooth movement of pedestrians, bicycles, and other non-prohibited persons or objects over the apparatus when it is not deployed. The apparatus 300 also includes two or more rollers 333 connected to the base and configured to facilitate lateral movement of the apparatus (i.e., horizontal motion of the base plate along the surface of a street or sidewalk) when it is being positioned or installed. The friction of the base plate with respect to the ground is illustrated schematically as friction 331 in FIG. 3. The tire spike 330 is also referred to herein as a "pointed tip."

It should also be noted that the locking bracket 122 in the apparatus 100 is referred to as a "locking mechanism" in the apparatus 300, and the deployable element 112 is referred to as an "upper plate" in the apparatus 300, due to its substantially rectangular shape and smooth, contiguous surface. In other embodiments, instead of the locking bracket mechanism 122, a cable may be attached to the deployable element and base. The cable may be very strong, such as is the case with aircraft cable, and the cable may assist in inhibiting motion of the vehicle by coupling the vehicle's motion to the base. The cable may be attached in the same location as the locking mechanism 122 to the base and deployable element (i.e., at the deployable element between the vehicle engagement end and base end, and between the two sides of the base. As an alternative, a locking mechanism or cable may be attached at a different location on the base and deployable element, such as at the vehicle engagement end of the deployable element and a corresponding location on the base.

Figure 4B:
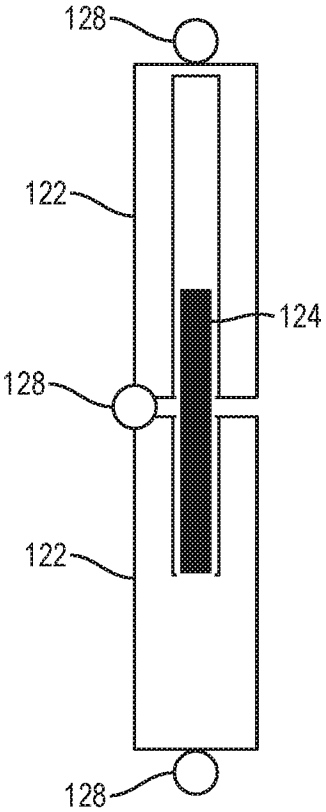
FIGS. 4A-4B illustrate the locking bracket of the embodiment of FIGS. 2A-2C and FIG. 3 in greater detail.
Figure 4A:
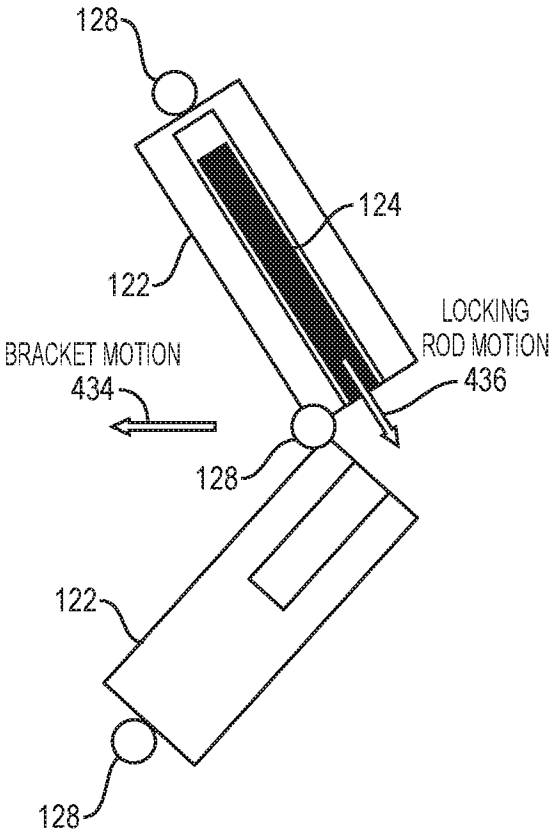

FIGS. 4A-4B illustrate the locking bracket 122 in FIGS. 2A-2C and 3 in greater detail. In particular, FIG. 4A is a side-view illustration of the locking bracket 122 in a partially deployed orientation. As deployment occurs, the hinge 128 connected to the deployable element 112 is raised, and the upper and lower portions of the bracket 122 are able to rotate with respect to each other via additional hinges 128. The middle hinge 128 has a net motion 434 at the center of the bracket 128, and eventually, the locking rod 124 is able to undergo gravitational induced motion 436 downward into the lower portion of the bracket 122. In other embodiments, a spring may be provided within the bracket 128 to push the locking rod 124 into the lower portion of the bracket, such that the induced motion 436 downward is spring-induced.

FIG. 4B is a side-view illustration of the bracket 122 in the fully deployed orientation. In this deployed orientation, the locking rod 124 is partially (i.e. approximately halfway) inserted into the lower portion of the bracket 122, and its motion is stopped such that the upper and lower portions of the bracket 122 remain fixed and aligned with each other.

Figure 5B:
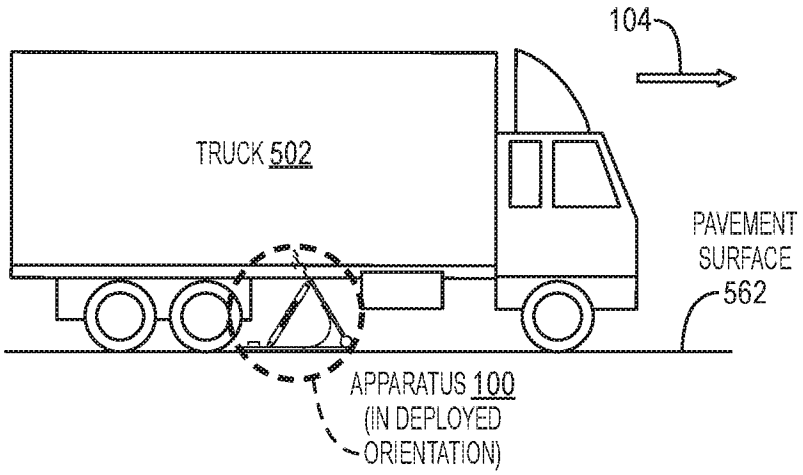
FIGS. 5A-5B are profile illustrations of a truck moving onto and over the apparatus of FIG. 1.
Figure 5A:
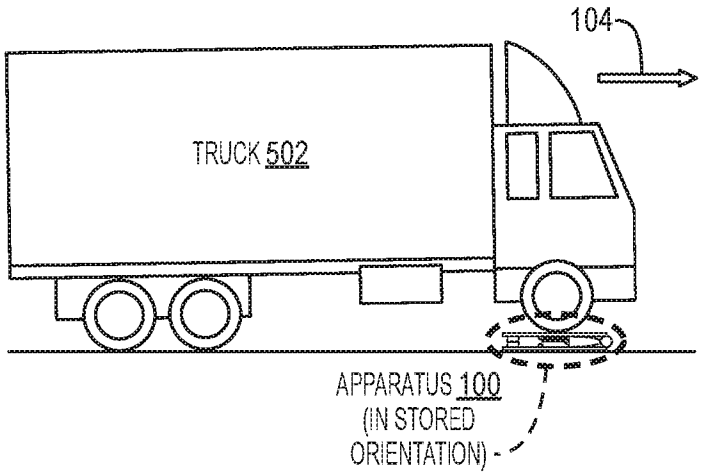

FIGS. 5A-5B are profile illustrations of a truck 502 moving in the direction 104 over the apparatus 100. In FIG. 5A, the apparatus 100 is in the stored orientation prior to the truck passing over it. When the front wheel of the truck 502 passes over the apparatus 100, the apparatus is triggered to deploy (e.g., by weight activation). Thus, the apparatus 100 has no effect on the front wheel. However, the apparatus 100 is deployed, as illustrated in FIG. 5B, prior to the truck's rear wheel reaching the apparatus.

In various embodiments, the deployment from the stored orientation to the deployed orientation may take as little as 10-100 milliseconds, such as between 10 and 50 milliseconds, between 10 and 20 milliseconds, etc. Fast deployment of the apparatus is desirable so that even vehicles moving at fairly high rates of speed may be stopped by the rear wheels engaging with the apparatus. However, even where embodiments are deployed in a greater amount of time, partial deployment can still be effective to stop the vehicle. For example, in some cases, the rear wheel may connect with the apparatus in a partially deployed orientation, and the wheel may further force the apparatus into the fully deployed orientation. Furthermore, in yet other cases, such as those illustrated embodiments including tire spikes at the vehicle engagement end of the deployable element, such as in FIG. 6B, the spikes may puncture the tire of the vehicle even in a partially deployed orientation. This is further illustrated in FIGS. 6A-6B.

Figure 6B:
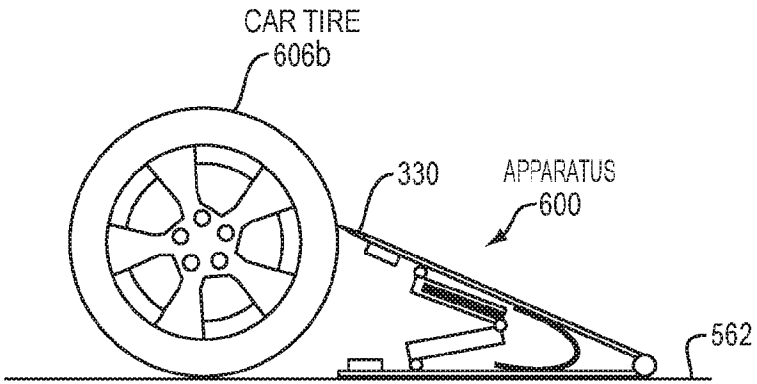
FIGS. 6A-6B are of profile views of a truck tire and car tire, respectively, engaging with an embodiment vehicle barrier apparatus.
Figure 6A:
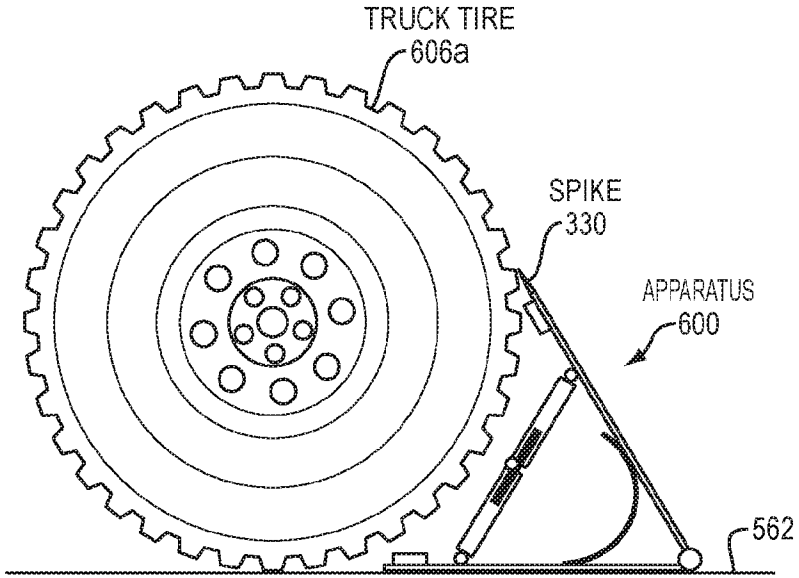

FIGS. 6A-6B are of profile views of a truck tire 606*a* and car tire 606*b*, respectively, engaging with a vehicle barrier apparatus 600. The apparatus 600 is similar to the apparatus 100 illustrated in FIGS. 2A-2C, except that it also includes the optional tire spikes 330 illustrated in FIG. 3. In the example of FIG. 6A, the truck tire 606*a* contacts the apparatus 600 in the fully deployed configuration. Further motion of the truck tire 606*a* is impeded due to friction of the apparatus 600, particularly the base, with the pavement on which it stands, and the weight of the one or more barrier modules. Moreover, the spikes 330 may also destroy the truck tire 606*a*, further providing impediment to forward motion of the truck. Even where a vehicle barrier apparatus does not fully stop a large truck completely, for example, it may greatly slow it down and impede its forward motion, allowing security personnel to have a much greater chance of neutralizing any threat. Furthermore, multiple vehicle barrier apparatuses may be placed in a path to guard against threats, such that an additional apparatus placed further in the path of the truck tire 606*a* may completely stop the truck.

FIG. 6B illustrates the car tire 606*b* contacting the apparatus 600 in the partially deployed orientation. In the situation illustrated in FIG. 6B, puncturing may occur first, while further forward motion of the car may be inhibited as the apparatus 600 fully deploys and catches the car tire 606*b*.

It should be understood that the truck and car tires illustrated in FIGS. 6A-6B are examples, and they may be rear tires that are destroyed or stopped after a front wheel of the vehicle activates the apparatus 600. However, in other embodiments, the embodiments may be triggered to deploy via a communication from a remote location, such as a security checkpoint or a handheld remote control. When this is the case, an apparatus such as the apparatus 600 may engage one or more front wheels of a vehicle in a similar manner. In this case of the barrier being deployed against a front wheel, the forward motion of the vehicle is more likely to be immediately impacted, because the ability to steer and control the vehicle will be lost in many cases. Furthermore, in a system that includes a force sensor placed in or on a street or sidewalk separate from an embodiment barrier apparatus, the force sensor may detect a vehicle and communicate a triggering signal to the apparatus prior to the vehicle reaching the apparatus. In these cases, the apparatus may likewise physically engage with one or more of the front tires of a vehicle to destroy the tires and otherwise inhibit motion of the vehicle.

Figure 7B:
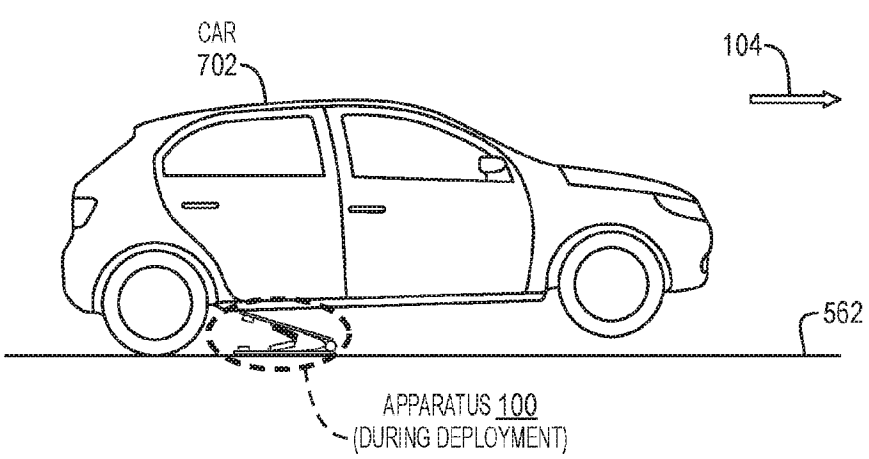
FIGS. 7A-7B are side-view illustrations of a car 702 contacting the apparatus 100 illustrated in FIGS. 2A-2C in the stored orientation and partially deployed orientation, respectively.
Figure 7A:
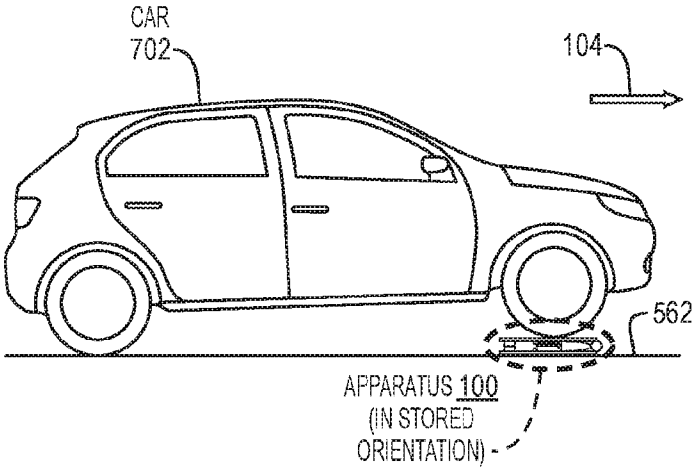

FIGS. 7A-7B are side-view illustrations of a car 702 contacting the apparatus 100 illustrated in FIGS. 2A-2C in the stored orientation and partially deployed orientation, respectively. In FIG. 7A, the front wheel of the car 702 passes over the apparatus 100 in the stored orientation, causing deployment to be triggered. However, due to the short wheelbase of the car 702, as well as the reduced clearance between the ground and the undercarriage of the car, the top of the apparatus 100 (i.e. vehicle engagement end of the deployable element) can hit the undercarriage of the car, preventing the two plates (i.e. deployable element 112 and base 110) from reaching their full separation, such that the deployable element is not fully deployed, at least initially. In this case, even before the rear wheels reach the apparatus 100, forward motion 104 of the car is impeded as the top of the apparatus 100 engages with the undercarriage of the vehicle and moves over the deploying apparatus. This will slow the car down, and the forward motion of the car can be stopped when the rear wheels reach the barrier and the rear tires are stopped or otherwise destroyed.

Figure 8:
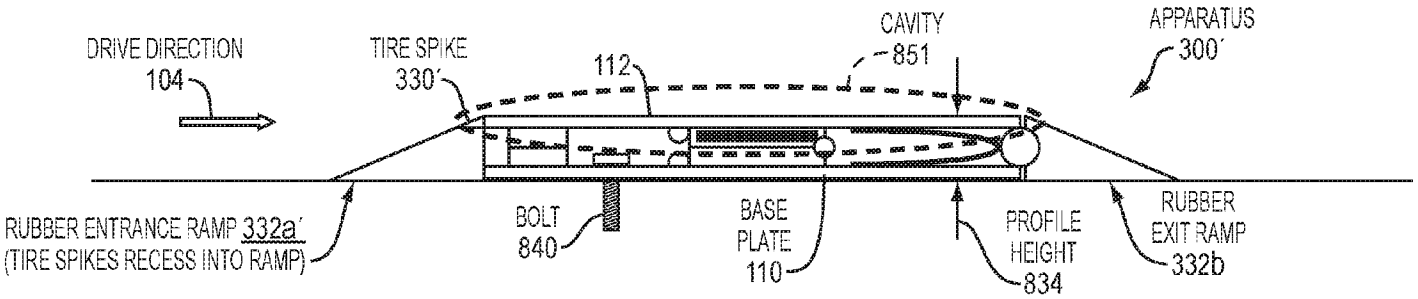
FIG. 8 is a profile view of an embodiment apparatus, similar to the apparatus illustrated in FIG. 3 but also including a base fastener and recesses in a rubber ramp into which tire spikes fit in the stored configuration.

FIG. 8 is a profile view of an apparatus 300' that is similar to the apparatus 300 illustrated in FIG. 3. However, the apparatus 300' is modified such that the vehicle engagement end of the deployable element, including one or more tire spikes 330', are configured to fit inside a recess in a rubber entrance ramp 332*a*'. The base of the apparatus 300', comprising the rubber entrance ramp 332*a*', the rubber exit ramp 332*b*, and the base plate 110, forms a cavity 852 into which the deployable element 112 may fit in the stored orientation. In this way, as illustrated in this profile view, a profile of the overall apparatus 300' can be essentially the same as the profile of the base, when in the stored orientation. This configuration eases the flow of vehicles and pedestrians over the vehicle barrier apparatus 300' when it is not deployed. Further, where the tire spikes 330' fit into recesses in the rubber entrance ramp 332*a*', the configuration is made safe such that it does not pose a hazard to vehicles or people in the un-deployed configuration. Further as illustrated in FIG. 8, the apparatus 300' has a profile height 834. The profile height 834 can be about 2-6 inches in certain embodiments, such as about 4 inches.

Figure 9:
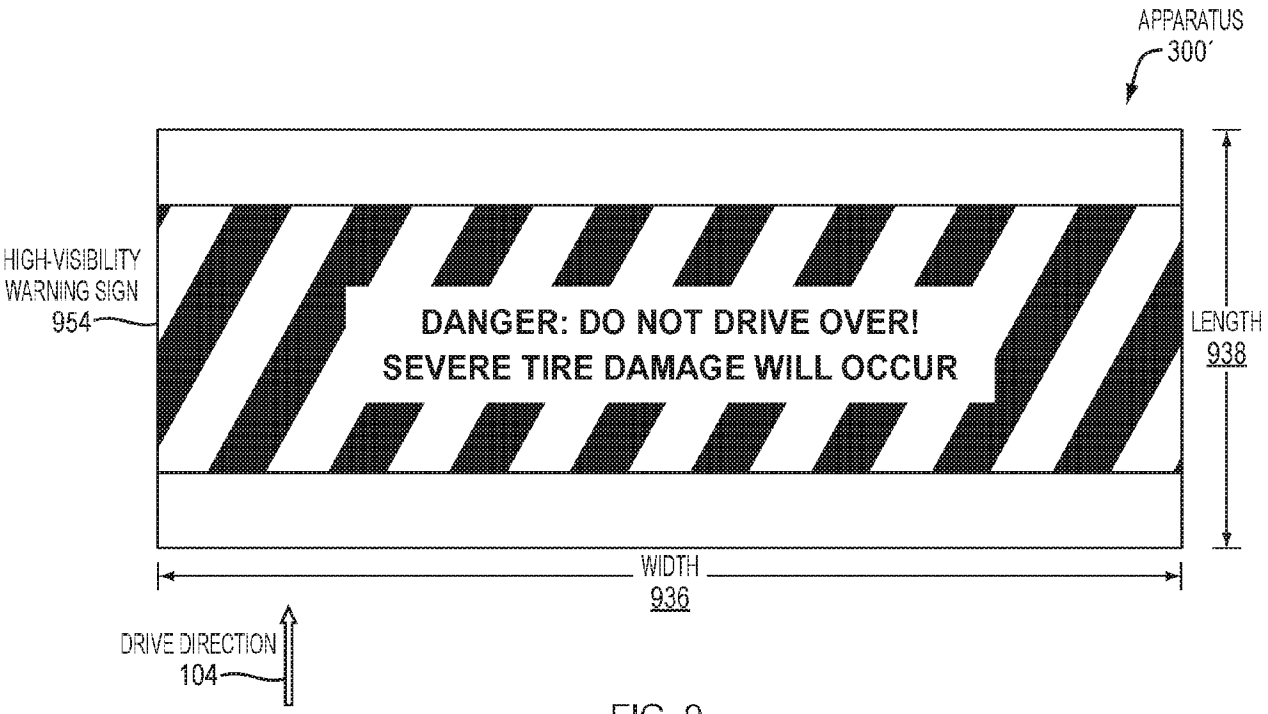
FIG. 9 is a top-view illustration of the apparatus in FIG. 8 showing a high-visibility warning sign.

FIG. 9 is a top-view illustration of the apparatus 300' in FIG. 8. The apparatus 300' has a width 936, which is defined as a lateral extent of the apparatus base perpendicular to the expected drive direction 104 of the vehicle over the apparatus. The apparatus 300' has a length 938, defined as a lateral extent of the apparatus base parallel to the expected drive direction 104 of a vehicle over the apparatus. The apparatus 300' includes a high-visibility warning sign 954 indicating "DANGER: DO NOT DRIVE OVER! SEVERE TIRE DAMAGE WILL OCCUR." In alternative embodiments, for more covert operation, a vehicle barrier apparatus may not include any warning features.

Figure 10A:
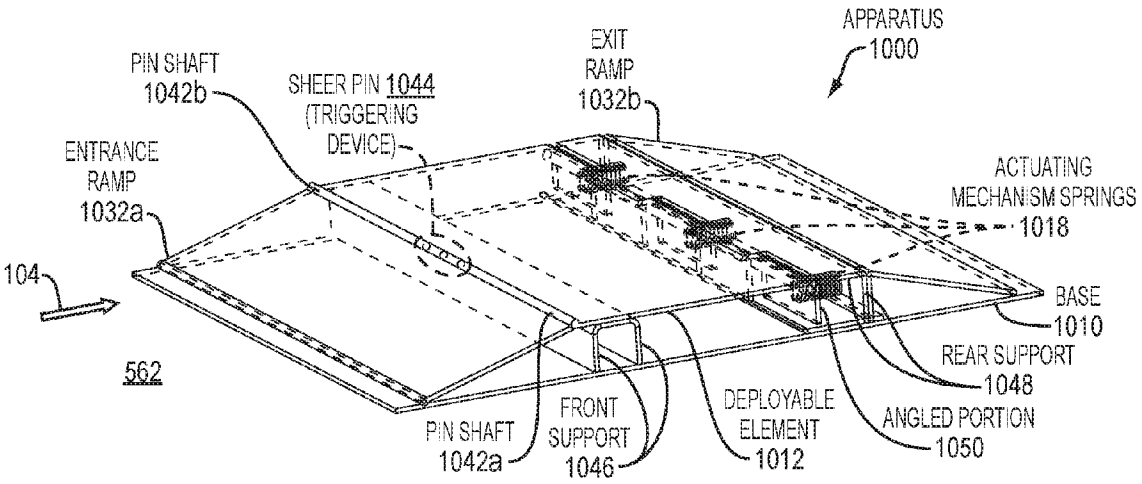
FIGS. 10A-10B are perspective-view illustrations of an embodiment vehicle barrier apparatus that employs a shear pin as a triggering device for triggering actuation of a deployable element.
Figure 10B:
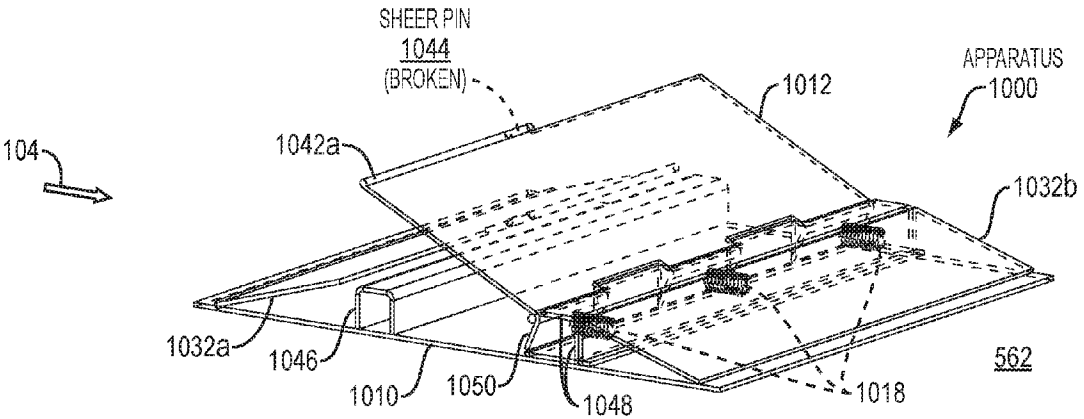

FIGS. 10A-10B are perspective-view illustrations of an embodiment vehicle barrier apparatus 1000 that employs a shear pin 1044 as a triggering device for triggering actuation of a deployable element 1012. An upside-down-U-shaped front support 1046 and a rear support bracket 1048 are affixed to a base plate 1010. The front support bracket 1046 supports a deployable element plate 1012 in the stored configuration, which is illustrated in FIG. 10A. In the stored configuration, the front support 1046 also indirectly supports an entrance ramp 1032*a*. The deployable element 1012 includes a pin shaft 1042*a*, while the entrance ramp 1032*a* includes a complimentary section of the pin shaft 1042*b*.

Held within at least part of each of the pin shaft sections 1042*a-b* in the stored configuration is the shear pin 1044, which is configured to be sheared in response to at least one of a weight and a momentum of an approaching vehicle. When a vehicle's wheel travels onto the entrance ramp 1032*a*, and where the weight or momentum of the vehicle is sufficient to shear the pin 1044, the shear pin breaks, allowing the entrance ramp 1032*a* to collapse, at least partially and at least temporarily, while the deployable element plate 1012 is initially fixed between the vehicle tire and the front support 1046. Once the vehicle tire passes over the deployable element plate 1012, a plurality of springs 1018, which serve as the actuating mechanism, push from the rear support 1048 toward an angled portion 1050 of the deployable element 1012, causing the element 1012 to rotate into a deployed orientation, which is illustrated in FIG. 10B.

FIG. 10B illustrates the deployed configuration of the apparatus 1000, with the shear pin triggering device 1044 broken, such that a portion of the shear pin may remain in the pin shaft section 1042*a*, while another portion of the shear pin 1044 may remain in the pin shaft portion 1042*b*. As is understood in the mechanical arts, a shear pin may be chosen with particular specifications to break when a shear force exceeding a certain value is applied. In this way, a shear pin may be chosen such that the apparatus 1000 may discriminate between the weight of a person and the weight of a heavier object, such as a car or truck. Furthermore, the shear pin 1044 may be selected to discriminate between the weight of a car, for example, and the weight of a truck, thus allowing for smaller vehicles to pass over the apparatus 1000 without triggering deployment, while reacting to a heavier weight of a truck, for example, to trigger actuation. Furthermore, in some embodiments, the apparatus 1000 may be designed to accommodate shear pins of a variety of specifications, such that different shear pins may be installed in the same apparatus for different applications. It should also be understood that other known components designed to be sheared, such as shear bolts, may be used in embodiments and may constitute the triggering device or a portion of the triggering device. Accordingly, the apparatus 1000 may be configured flexibly depending on the security needs of a given environment and application.

Figure 11A:
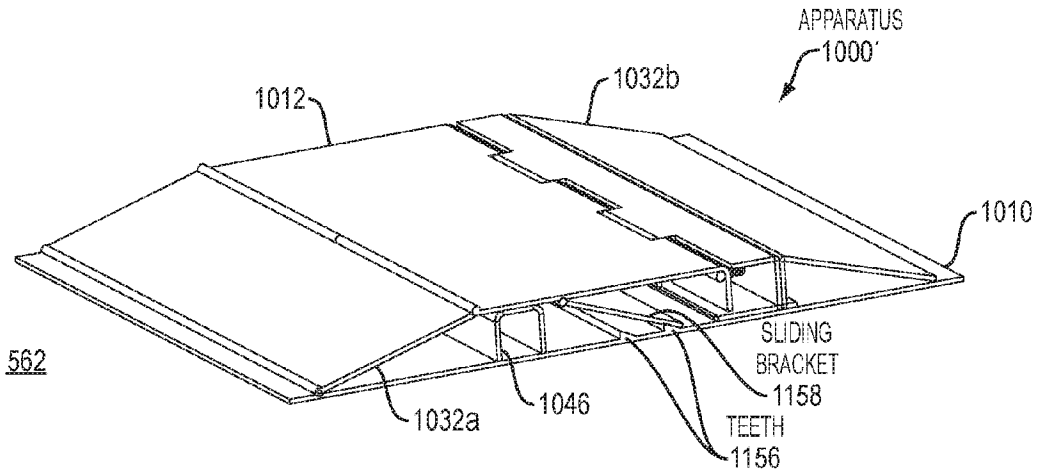
FIGS. 11A-11B are perspective-view and profile-view illustrations, respectively, of an embodiment similar to the apparatus illustrated in FIGS. 10A-10B but also including a sliding bracket and teeth for securing the deployable element in the deployed orientation.
Figure 11B:
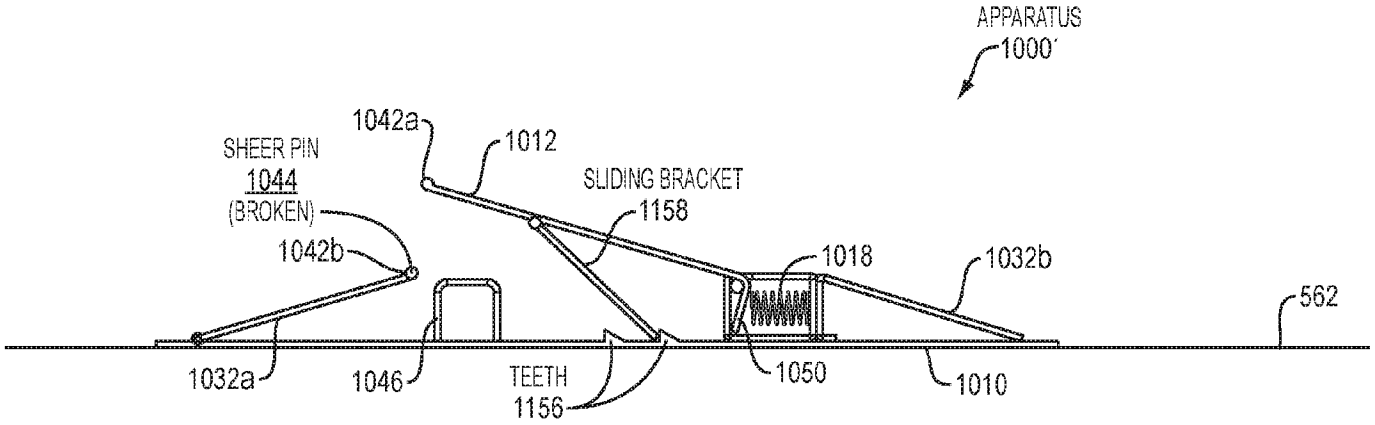

FIGS. 11A-11B are perspective-view and profile-view illustrations of a modified apparatus 1000', respectively, which is similar to the apparatus 1000 illustrated in FIGS. 10A-10B. The apparatus 1000' includes teeth 1156 in the base plate 1010 that are configured to catch and hold a sliding bracket 1158 that is rotatably connected to the deployable element 1012. When the shear pin 1044 breaks, triggering deployment of the apparatus 1000', the deployable element 1012 rises, rotating with respect to the base plate 1010, and the sliding bracket 1158 then slides toward the left of FIG. 11B, over the teeth 1156, and the teeth 1156 then keep the sliding bracket 1158 from sliding back toward the right, thus maintaining the deployable element 1012 raised in the deployed orientation. Sliding bracket 1158 can either fall towards the baseplate 1010 under gravity when deployable element 102 rises, as illustrated in FIGS. 11A-11B, or the downward motion can be optionally assisted with a spring (not shown in FIGS. 11A-11B). In this way, the force of the actuating springs 1018 is supplemented by the combined action of the sliding bracket 1158 and teeth 1156, such that the deployed orientation is more easily and stably maintained when a vehicle tire intersects with the apparatus 1000' in the deployed orientation, or in a partially deployed orientation.

Figure 12B:
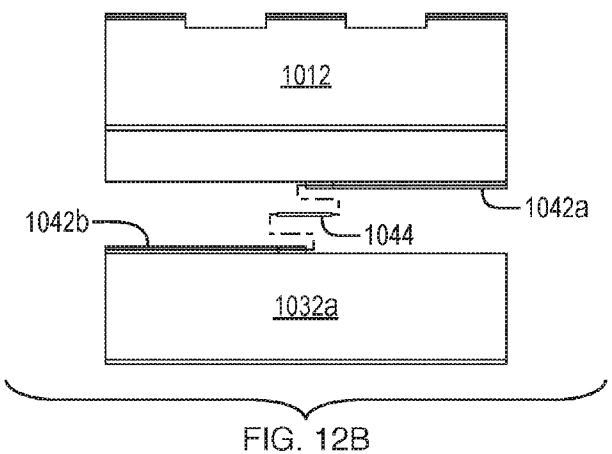
FIGS. 12A-12C illustrate the shear pin-related aspects of the embodiments illustrated in FIGS. 10A-10B and FIGS. 11A-11B in greater detail.
Figure 12A:
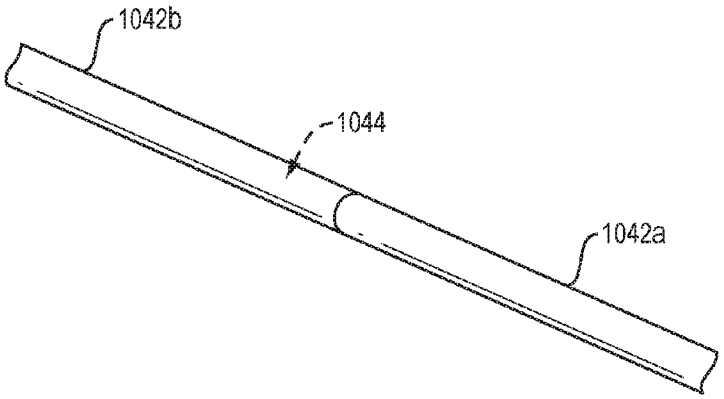
Figure 12C:
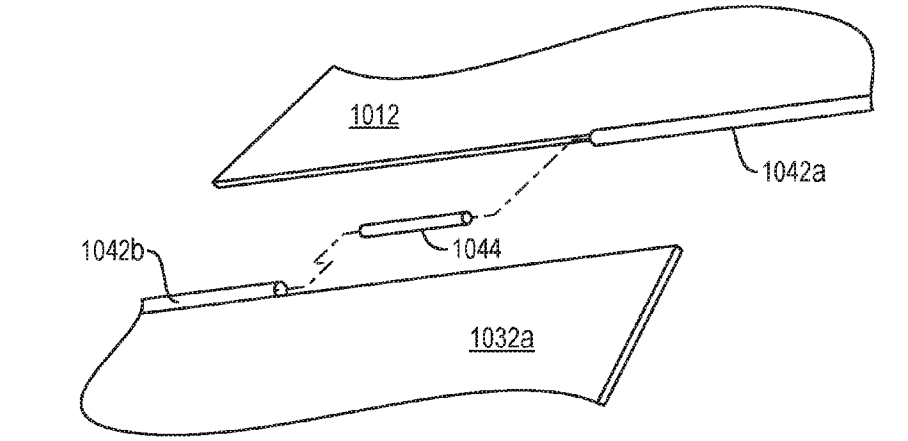

FIGS. 12A-12C illustrate the shear pin-related aspects of the embodiment apparatus 1000 illustrated in FIGS. 10A-10B and the embodiment apparatus 1000' illustrated in FIGS. 11A-11B in greater detail. FIG. 12A is a perspective illustration of the shear pin 1044 situated within the pin shaft sections 1042*a* and 1042*b* in the stored orientation. FIG. 12B is an exploded, top-view, illustration of the entrance ramp 1032*a*, the deployable element plate 1012, and the shear pin 1044 inserted into the pin shaft sections 1042*a* and 1042*b*. FIG. 12C is a perspective-view, exploded-view illustration of the entrance ramp 1032*a*, deployable element 1012, and pin 1044 placement, corresponding to the top-view illustration in FIG. 12B.

Figure 13A:
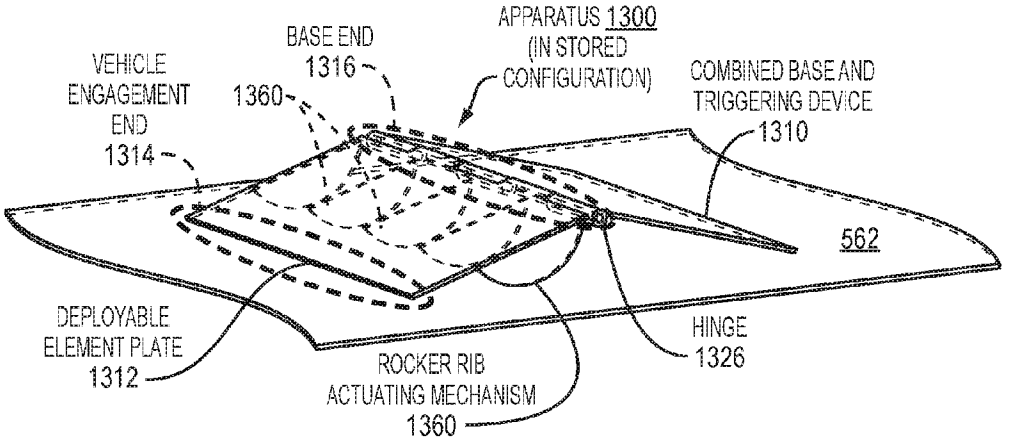
FIGS. 13A-13C are illustrations of an embodiment apparatus in a stored configuration, the embodiment including a rocker rib actuating mechanism.
Figure 13B:
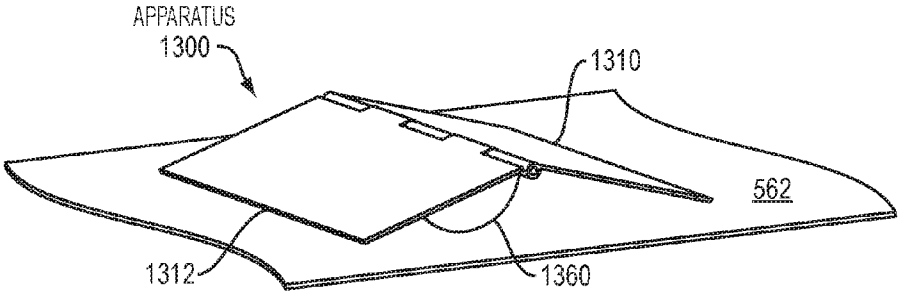
Figure 13C:
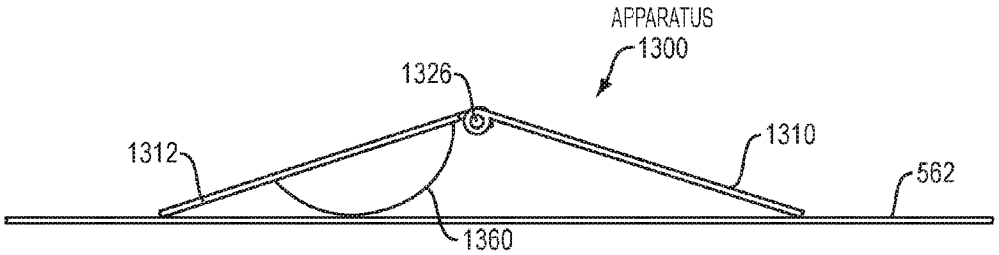

FIGS. 13A-13C are illustrations of an apparatus 1300 in a stored configuration. The apparatus 1300 includes a rocker rib actuating mechanism 1360 that is configured to rotate a deployable element plate 1312 from the stored orientation to a deployed orientation (illustrated in FIGS. 14A-14B) using at least one of a weight and a momentum of an impinging vehicle. The rocker rib of actuating mechanism 1360 includes a series of ribs 1360 attached to an underside of the deployable element plate 1312. The plate 1312 has a vehicle engagement end 1314 and a base end 1316. The base end is rotatably coupled to a combined base and triggering device 1310 via a hinge 1326. The combined base and triggering device 1310 is also a plate-type base in the apparatus 1300.

Unlike the embodiments illustrated in FIGS. 2A-2C and 10A-10B, for example, in the apparatus 1300, the combined base and triggering device 1310 does not lay flat against the pavement 562 in the stored configuration. Instead, a rear edge of the base 1310 rests on the pavement 562, while a front end is connected to the base end of the deployable element 1316 via the hinge 1326. The rocker rib of 1360 is mechanically coupled to the deployable element plate 1312 and causes the element 1312 to rotate in response to a trigger. The combined base and triggering device 1310 acts as a triggering device because a vehicle can traverse the deployable element plate 1312 in the stored configuration, drive up to the base end 1316, and then down the base 1310. As a car tire presses on the combined base and triggering device 1310, no longer supported fully by the rocker rib 1360, the combined base 1310 collapses to lie substantially flat on the pavement 562, rotated about the rocker rib 1360, such that the vehicle engagement end 1314 of the deployable plate 1312 is rotated to the deployed configuration.

FIG. 13B is a perspective-view illustration of the apparatus 1300 illustrated in FIG. 13A, and FIG. 13C is a profile-view illustration of the apparatus 1300.

Figure 14A:
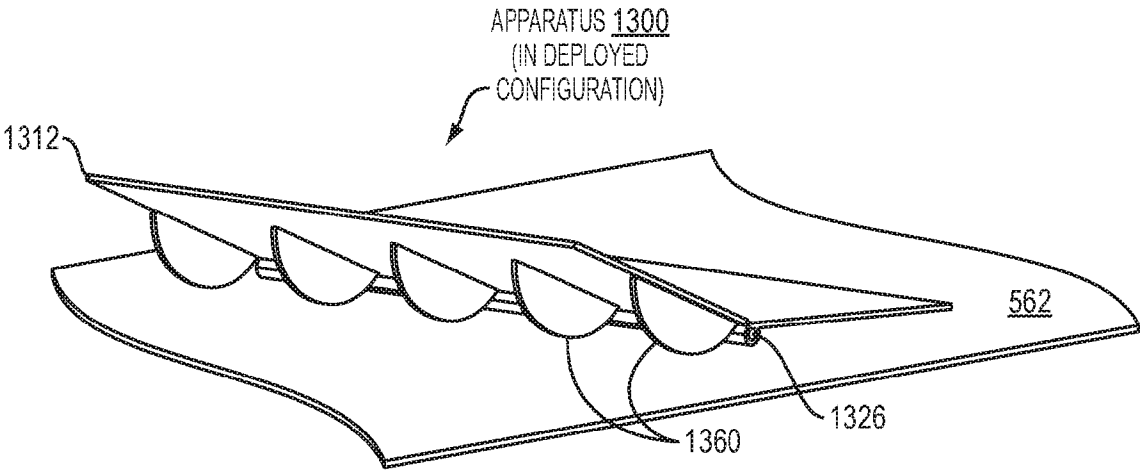
FIGS. 14A-14B are perspective-view and profile-view illustrations, respectively, of the embodiment of FIGS. 13A-13C in the deployed configuration.
Figure 14B:
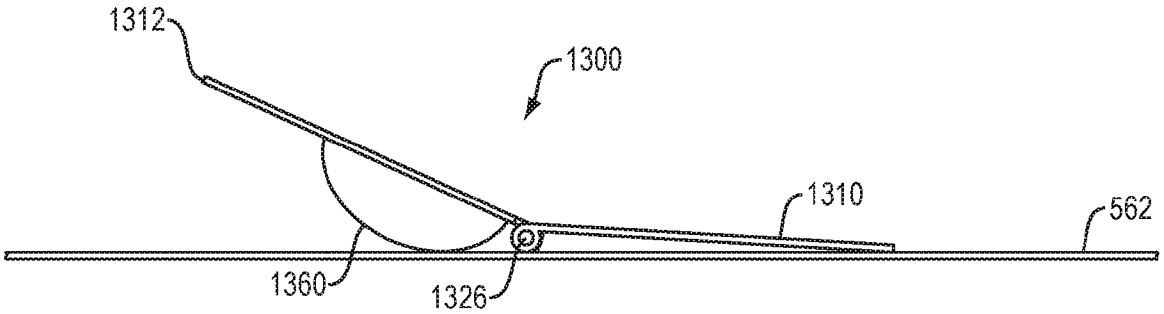

FIGS. 14A-14B are perspective-view and profile-view illustrations of the apparatus 1300 in FIGS. 13A-13C in the deployed configuration. The function of the apparatus 1300 is illustrated further in connection with an impinging car in FIGS. 15A-15D.

Figure 15A:
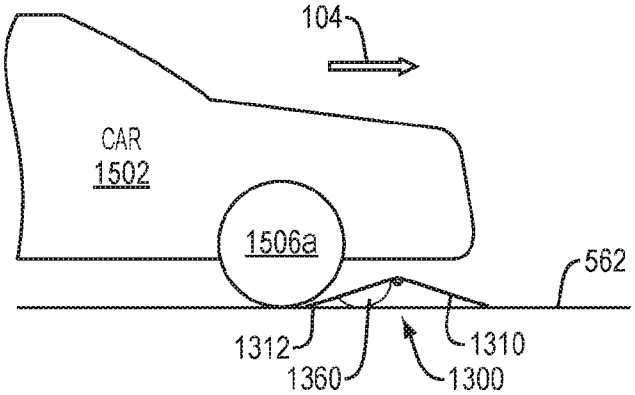
FIG. 15A shows a profile view of a car with the front wheel just before impinging on the apparatus of FIGS. 13A-13C in the stored configuration.

FIG. 15A shows a profile view of a car 1502 with the front wheel 1506*a* just before impinging on the apparatus 1300 in the stored configuration. The front wheel 1506*a* travels up the deployable element 1312, supported by the rocker rib 1360.

Figure 15B:
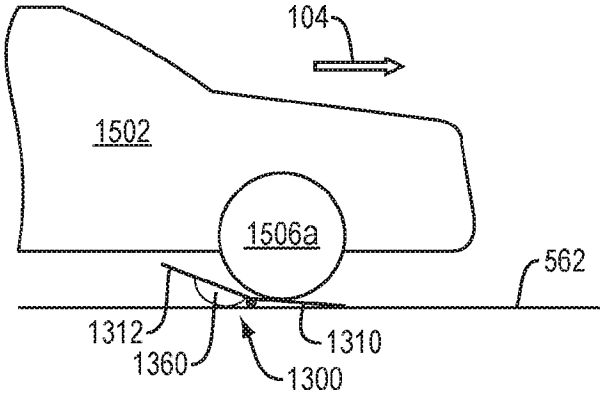
FIG. 15B is an illustration similar to that of FIG. 15A, except that the front wheel of the car has passed over the top of the rocker rib.

FIG. 15B is an illustration similar to that of FIG. 15A, except that the front wheel 1506*a* of the car has passed over the top of the rocker rib 1360 and caused the combined base plate and triggering device 1310 to collapse toward the ground, triggering the deployable element plate 1312 to be rotated about the hinge 1326 to the deployed orientation, with the rocker rib 1360 continuing to support the plate 1312 against the pavement 562.

Figure 15C:
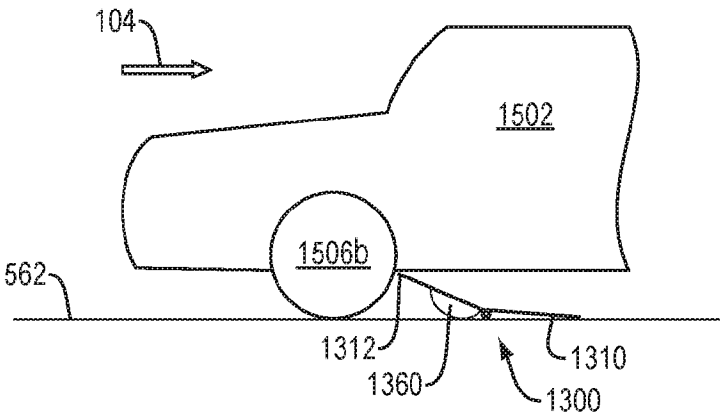
FIG. 15C illustrates how a rear tire of the car of FIGS. 15A-15B impinges on the apparatus in the deployed orientation, such that the vehicle engagement end of the deployed plate engages the car physically to impair its motion.

FIG. 15C illustrates how a rear tire 1506*b* of the car impinges on the apparatus 1300 in the deployed orientation, such that the vehicle engagement end of the plate 1312 engages the vehicle physically to impair the motion of the car 1502.

Figure 15D:
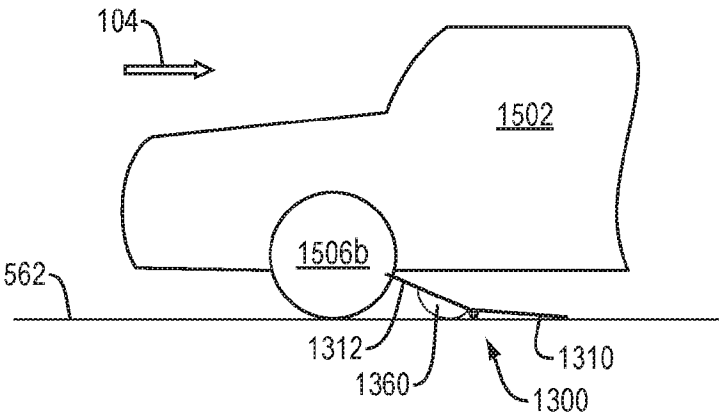
FIG. 15D is an illustration of the car and apparatus of FIGS. 15A-15C at a time slightly later than in FIG. 15C, illustrating further engagement.

FIG. 15D is an illustration of the car 1502 and apparatus 1300 at a time slightly later than in FIG. 15C. At the time illustrated in FIG. 15D, the vehicle engagement end of the deployable plate element 1312 has physically engaged with the rear tire 1506*b* to stop or inhibit motion of the car 1502.

Figure 16A:
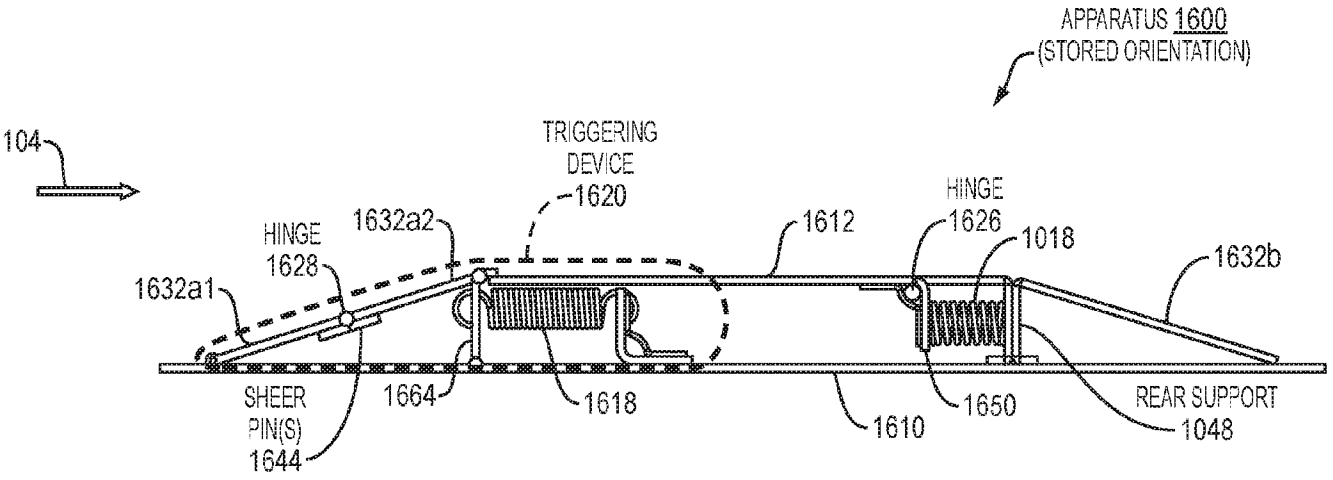
FIG. 16A is a profile-view illustration of an embodiment vehicle barrier apparatus, in a stored orientation, with a shear pin-triggered folding ramp.

FIG. 16A is a profile-view illustration of a vehicle barrier apparatus 1600 in a stored orientation. The apparatus 1600 includes a base plate 1610 and deployable element plate 1612 with an angled portion 1650. Like the apparatus 1000 illustrated in FIGS. 10A-10B and the apparatus 1000' illustrated in FIGS. 11A-11B, the apparatus 1600 includes a spring actuating mechanism 1018 that pushes against the angled portion 1650 of the plate 1612 in order to rotate the plate 1612. The plate 1612 is rotatably coupled to the base plate 1610 via a hinge 1626. The spring 1018, which is braced against a rear support 1048, pushes the angled portion 1650 of the deployable element 1612 into the deployed orientation, when triggered via the latch releasing, which is illustrated in FIG. 16B.

In the stored orientation, the deployable plate 1612 is held in the stored orientation and prevented from rotating by a latch bracket 1664, which is pulled by a latch spring 1618 to latch the edge of the plate 1612. The apparatus 1600 includes a front ramp 1632*a* with lower and upper portions 1632*a*1 and 1632*a*2, respectively, and a rear ramp 1632*b*. The lower and upper portions 1632*a*1 and 1632*a*2 of the front ramp are rotatably coupled to each other via a hinge 1628, and one or more shear pins 1644 prevent the portions 1632*a*1 and 1632*a*2 from folding with respect to each other in the stored orientation illustrated in FIG. 16A. The upper portion 1632*a*2 is rotatably coupled to the latch bracket 1664. The stored configuration illustrated in FIG. 16A is maintained as long as no object heavy enough to cause the pins 1644 to shear traverses the front ramp 1632*a*. Together, the ramp sections 1632*a*1 and 1632*a*2, the hinge 1628, the sheer pins

1644, the latch bracket 1664, and the latch spring 1618 form a triggering device 1620 that is purely mechanical and requires no electrical power source. This embodiment, as well as other disclosed embodiments that do not rely on electrical power, can be convenient portable modules that are easily place where needed to address security needs.

Figure 16B:
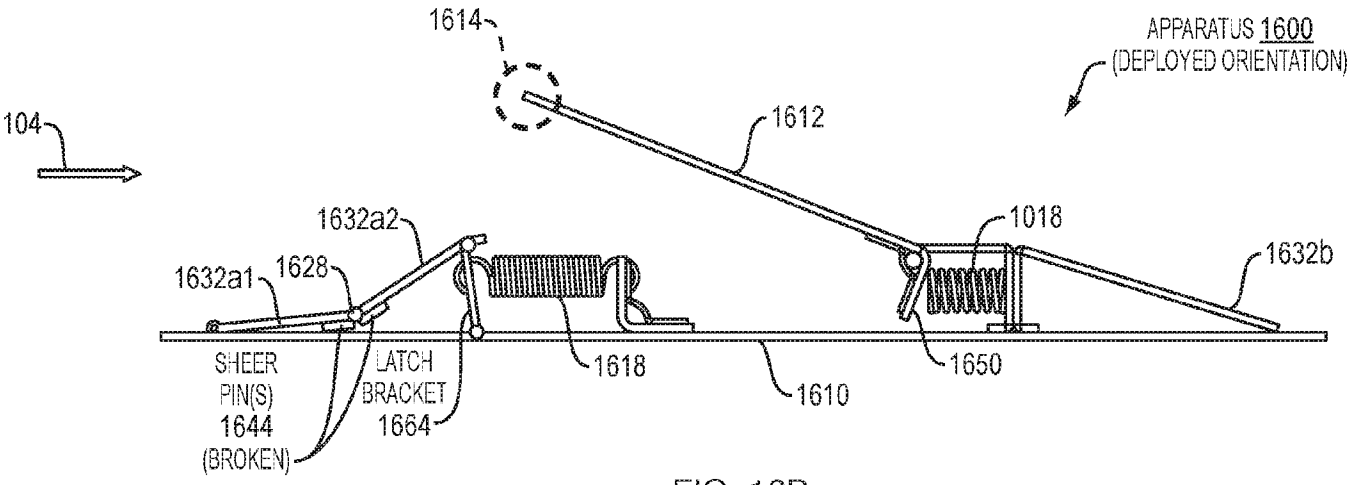
FIG. 16B is a profile-view illustration of the apparatus of FIG. 16A in the deployed orientation.

FIG. 16B is a profile-view illustration of the apparatus 1600 in the deployed orientation, with the deployable plate 1612 rotated such that the vehicle engagement end is pointing upward. This occurs when a vehicle coming in the direction 104 traverses the front ramp 1632*a*, causing the shear pins 1644 to shear and the front ramp sections 1632*a*1 and 1632*a*2 to fold. In turn, this causes the upper portion 1632*a*2 of the front ramp to pull the latch bracket 1664 in a direction opposite the direction 104, releasing the vehicle engagement end of the deployable plate 1612 and allowing the spring actuator 1018 to rotate the plate 1612 to the deployed orientation using stored spring energy. The vehicle engagement end 1614 can then engage with a vehicle to inhibit motion.

In alternative embodiments, an apparatus similar to the apparatus 1600 may include teeth and a sliding bracket, similar to those illustrated in FIGS. 11A-11B, or a locking bracket similar to that illustrated in FIGS. 2A-2C, or a locking cable as described hereinabove, in order to further secure the plate 1612 in the deployed orientation.

Figure 17B:
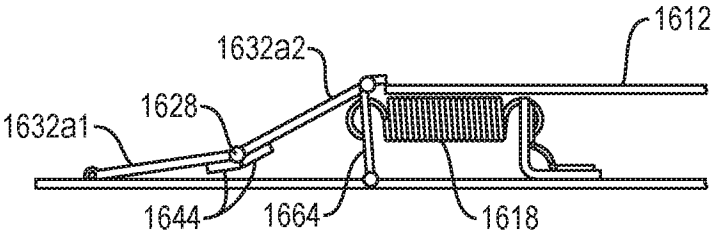
FIGS. 17A-17D are profile-view illustrations of the front of the apparatus of FIGS. 16A-16B, in various stages of deployment.
Figure 17A:
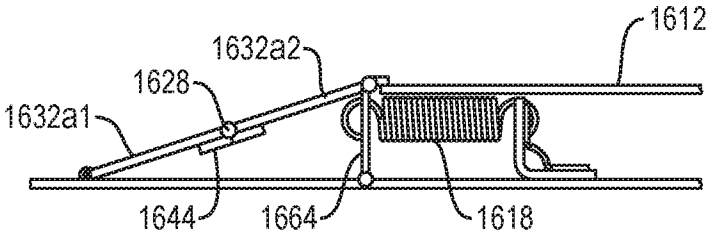

FIGS. 17A-17D are profile-view illustrations of the front of the apparatus 1600, including the front ramp 1632*a*1 and 1632*a*2. FIGS. 17A-17D illustrate in greater detail the process of deployment. FIG. 17A shows the stored orientation, wherein the shear pin 1644 remains intact and wherein the deployable plate element 1612 is still latched, prior to a vehicle traversing the ramp. FIG. 17B illustrates a later time, after a vehicle has just broken the shear pins 1644, and the ramp 1632*a* is beginning to fold, but the deployable plate element 1612 has not yet been released by the latch 1664.

Figure 17D:
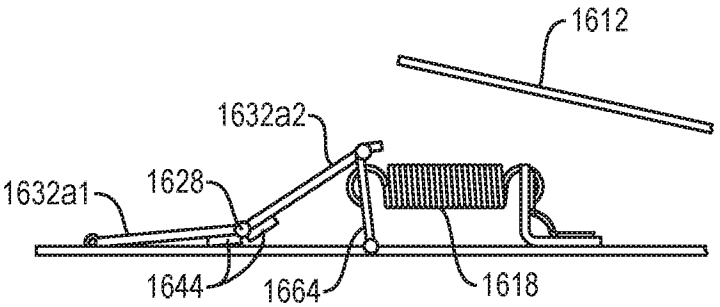
Figure 17C:
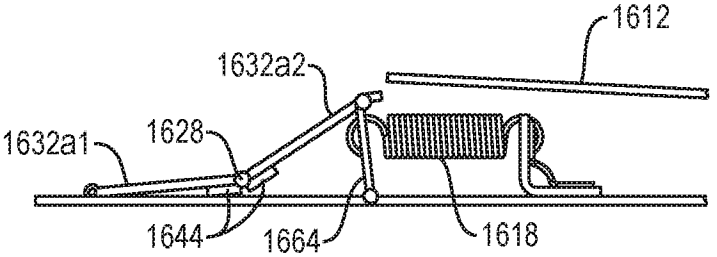

FIG. 17C illustrates a time slightly later than in FIG. 17B, when the front ramp 1632*a* has further collapsed and the deployable plate element 1612 has just been released and is beginning to rotate. FIG. 17D shows the apparatus at a slightly later time, when the ramp 1632*a* has collapsed and folded to the extent possible, and the deployable plate element 1612 has rotated fully to the deployed orientation.

Figure 18B:
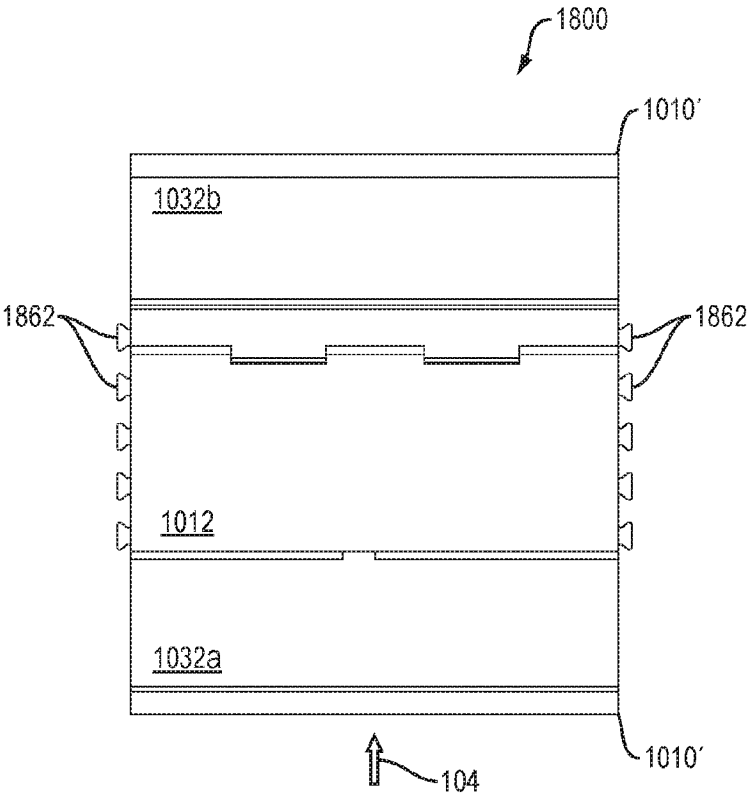
FIG. 18B is a top-view illustration of the interlocking apparatus of FIG. 18A.
Figure 18A:
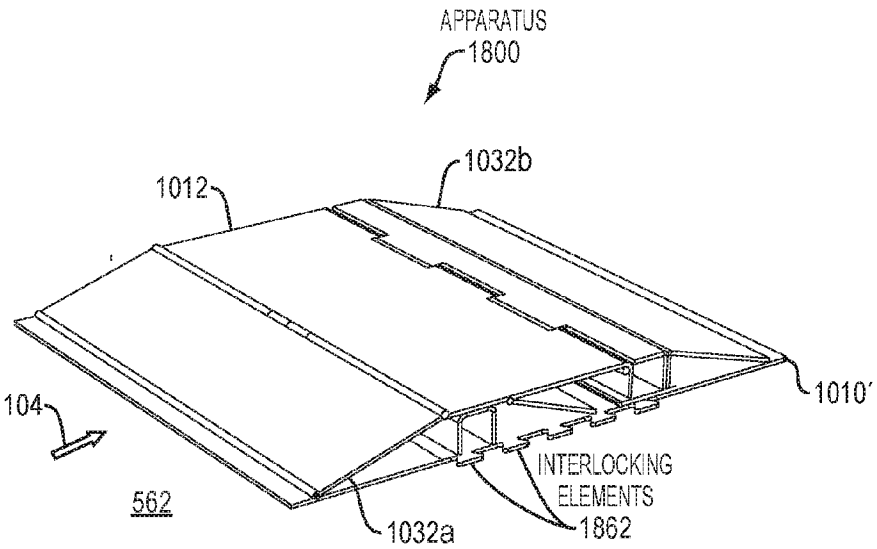
FIG. 18A is a perspective-view illustration of a vehicle barrier apparatus similar to that of FIGS. 11A-11B but including includes interlocking elements for connecting bases of two or more barrier modules together.

FIG. 18A is a perspective-view illustration of a vehicle barrier apparatus 1800 that is the same as the apparatus 1000' illustrated in FIGS. 11A-11B, except that the apparatus 1800 includes interlocking elements 1862 as part of a base 1010'. The interlocking elements 1862 are configured to attach the base 1010' of one vehicle barrier apparatus 1800 to one or more corresponding bases 1010' of other vehicle barrier apparatuses 1800 having similar interlocking elements 1862. In this manner, a very wide barrier can be made from smaller modules, in which each module comprises an apparatus 1800 that is individually manageable.

In some embodiments, the width of an apparatus may be approximately 4 feet, with a length along the drive direction of approximately 2 feet. Individual apparatus modules may be placed side by side with each other to create 8 foot, 12 foot, or 16 foot wide protection zones, for example. In a case where ½ inch steel is used to make the bottom plate base and ¼ inch steel plate is used to make the deployable element top plate, the steel in each module may weigh approximately 250 pounds. With additional hardware included in a given apparatus, each module apparatus may weigh approximately 300 pounds, allowing it to be moved and handled relatively easily with a fork lift or winch, for example. The individual apparatus modules may be designed to lock together using the elements 1862 when they are placed side by side, such that the combined weight and size of the modules may further impede any impinging vehicle, even if not all of the modules deploy.

In the embodiment apparatus 1800, the interlocking elements 1862 are in a dovetail pattern. However, in other embodiments, other shapes may be used for interlocking elements. Furthermore, in other embodiments, apparatus modules may be connected together using bolts or other known means attached to respective base plates or other portions of respective barrier apparatus modules.

FIG. 18B is a top-view illustration of the apparatus 1800 including the modified base plate 1010' having the interlocking elements 1862 on each side of the base plate.

Figure 19A:
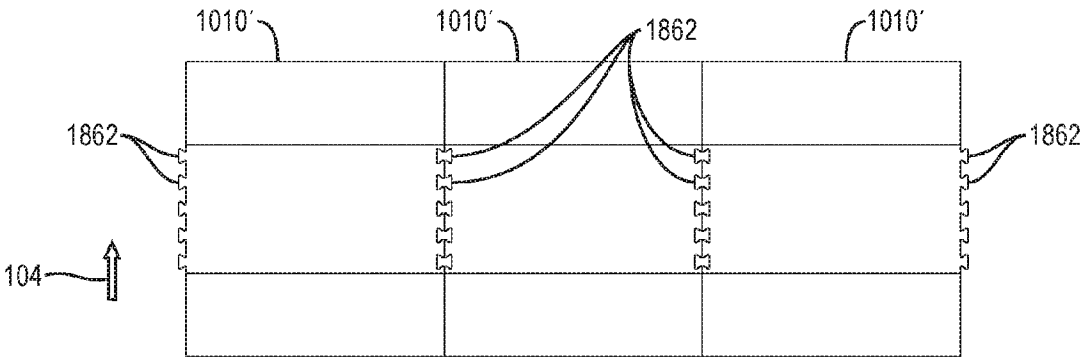
FIG. 19A is a top-view illustration of three base plates with the configuration of FIGS. 18A-18B connected together.

FIG. 19A is a top-view illustration of 3 base plates 1010', the same as those illustrated in FIGS. 18A-18B, with interlocking dovetail elements 1862. The bases 1010' are interlocked together to form a barrier that is three times the width of a single barrier. It should be understood that, in other embodiments, the bases or other components of apparatus modules may be connected together with a spacing between the bases.

Figure 19B:
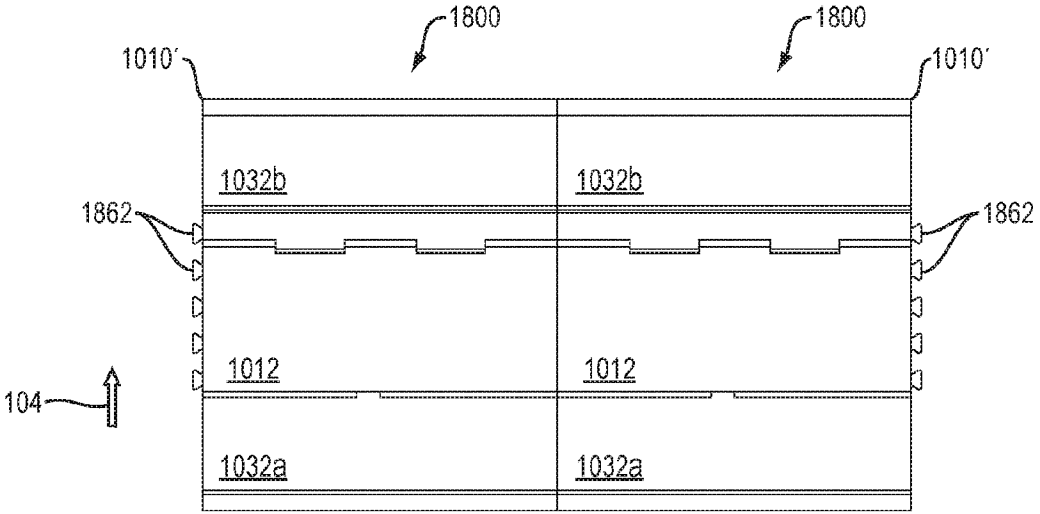
FIG. 19B is a top-view illustration of two complete apparatus modules with the configuration of FIGS. 18A-18B connected via the interlocking elements in the respective bases.

FIG. 19B is a top-view illustration of two complete apparatus 1800 modules coupled together via the interlocking elements 1862 that are part of the respective bases 1010'. It should be understood that barriers may be formed of multiple apparatus modules oriented lengthwise, along a potential drive direction of a vehicle, in addition to being connected together widthwise, as illustrated in FIGS. 19A-19B. For relatively narrow areas that need to be protected, such as a sidewalk, for example, a single eight-foot barrier may be placed every 50 meters or so along the sidewalk, or at key entry points where vehicles could potentially drive onto the sidewalk. For wider areas, the barriers may be placed next to each other, or even staggered along the direction of motion.

Figure 20:
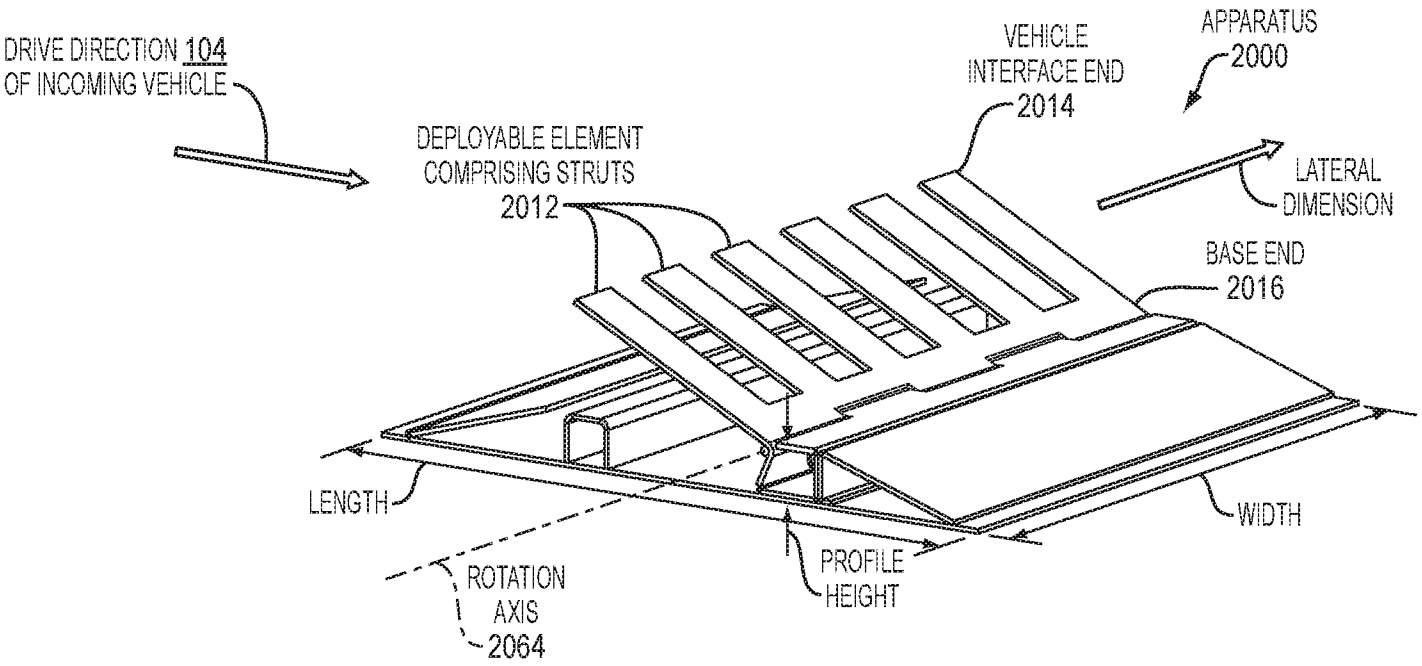
FIG. 20 is a perspective-view illustration of an embodiment vehicle barrier apparatus that includes struts.

FIG. 20 is a perspective-view illustration of a vehicle barrier apparatus 2000 that is similar to the apparatus 1000 illustrated in FIGS. 10A-10B. However, the apparatus 2000 has a deployable element that comprises multiple struts 2012 instead of the single deployable plate element 1012 in FIGS. 10A-10B. In the apparatus 2000, the struts 2012 rotate about a common axis of rotation 2064 that comprises a hinge at a base end 2016 of the deployable element struts 2012. A vehicle interface end 2014 of the struts 2012 is configured to engage with a vehicle to inhibit motion of the vehicle in the deployed orientation illustrated in FIG. 20. As illustrated in FIG. 20, the struts 2012 point in a direction opposite to, but parallel to, the drive direction 104 of an expected incoming vehicle. Accordingly, the struts 2012 also point in a direction perpendicular to a lateral dimension indicated in FIG. 20, which is perpendicular to the nominal, expected drive direction 104 of an incoming vehicle to be stopped.

Figure 21A:
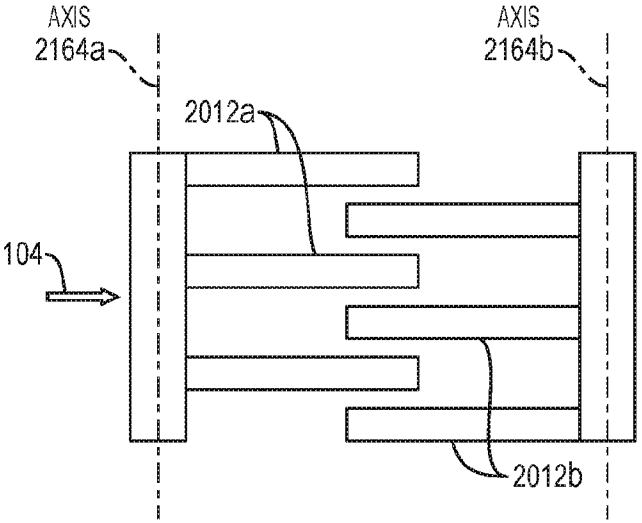
FIG. 21A is a top-view illustration of struts pointing in different directions and interdigitated with each other.

FIG. 21A is a top-view illustration of struts 2012*a* that are similar to the strut elements 2012 in FIG. 20. The struts 2012*a* are attached to each other near an axis of rotation 2164*a* about which the struts 2012*a* can rotate for deployment. Moreover, various embodiments may protect against vehicle intrusion from two different directions and may have struts, or other deployable element configurations such as plates, that point in different directions, such as opposite directions. The partial apparatus illustrated in FIG. 21A also includes struts 2012*b* that point in a direction opposite the struts 2012*a*. The struts 2012*b* rotate about an axis of rotation 2164*b*, such that there are two axes of rotation 2164*a* and 2164*b* with two corresponding directions of rotation for the corresponding struts.

Figure 21B:
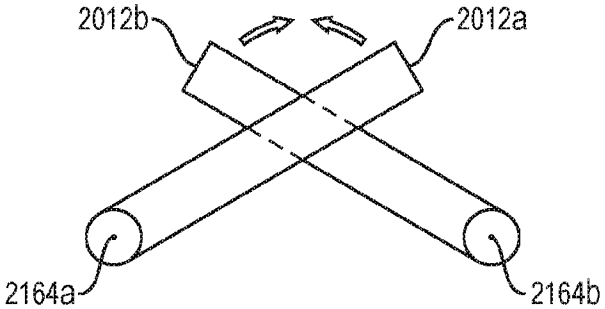
FIG. 21B is a side-view illustration of the struts in FIG. 21A being moved to the deployed orientation by rotation with respect to respective axes.

FIG. 21B is a side-view illustration of the struts 2012*a* and 2012*b* in FIG. 21A being moved to the deployed orientation by rotation with respect to the axis 2164*a* and 2164*b*, respectively. Moreover, although not required, the struts 2012*a* and 2012*b* are interdigitated with each other, such that the struts 2012*a* extend between respective struts 2012*b*, such that the struts of the two sets are staggered in their positioning. An interdigitated or staggered configuration such as that illustrated in FIGS. 21A-21B can be useful for a compact configuration, for example.

Figure 21C:
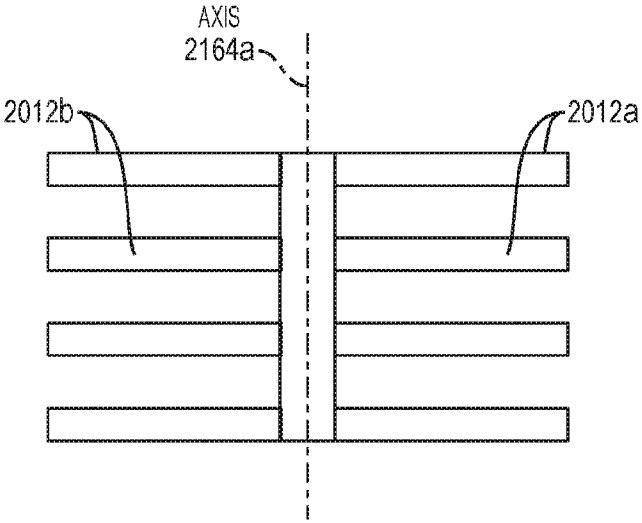
FIG. 21C is a top-view illustration of struts pointing in different directions and configured to rotate about a common axis of rotation.

FIG. 21C is a top-view illustration of the struts 2012*a* and 2012*b* configured to rotate about a common axis of rotation 2164*a*. In the stored configuration illustrated in FIG. 21C, the struts 2012*a* and 2012*b* point in exactly opposite directions.

Figure 21D:
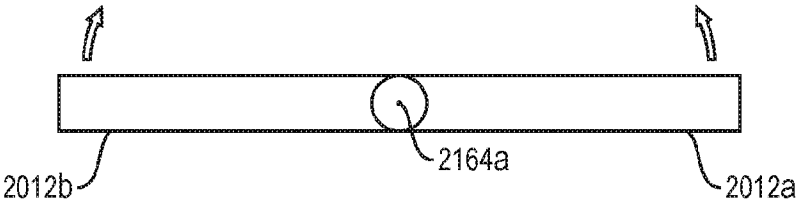
FIG. 21D is a side-view illustration of the struts shown in FIG. 21C.

FIG. 21D is a side-view illustration of the struts 2012*a* and 2012*b* in the configuration shown in FIG. 21C. As also illustrated in FIG. 21D, the struts 2012*a* and 2012*b* rotate about the common axis of rotation 2164*a*. However, as illustrated by the arrows in FIG. 21D, showing the motion of the struts toward the deployed orientation, the struts 2012*a* and 2012*b* have different directions of rotation about the common axis 2164*a*.

Figure 22A:
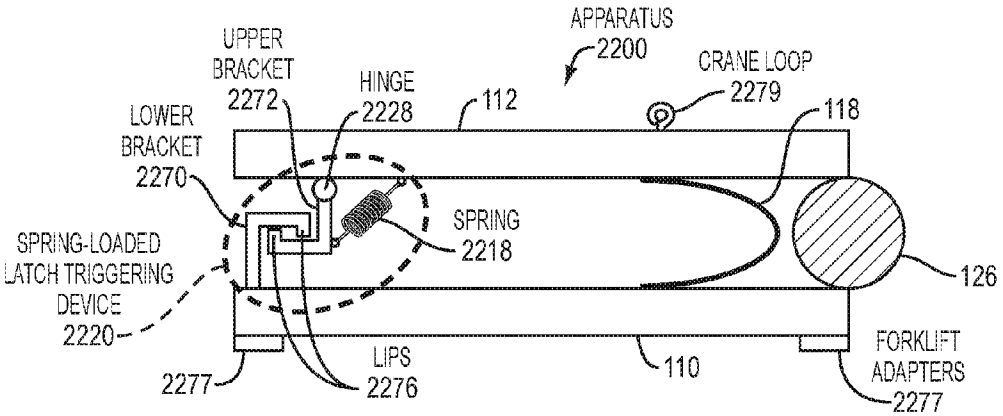
FIG. 22A is a profile-view illustration of an embodiment apparatus having a spring-loaded latch triggering device.

FIG. 22A is a profile-view illustration of an apparatus 2200 that has many similarities with the apparatus 100 illustrated in FIG. 2A. However, the apparatus 2200 is modified to include a spring-loaded latch triggering device 2220 that is configured to be unlatched when sufficient weight impinges upon the upper plate deployable element 112, thus triggering the spring actuator mechanism 118 to move the deployable element 112 to the deployed orientation. In particular, the spring-loaded latch triggering device 2220 includes a lower bracket 2270 mechanically coupled to the base 110. The triggering device 2220 also includes an upper bracket 2272 mechanically coupled to the deployable element plate 112 via a hinge 2228. A spring 2218 mechanically connects the upper bracket 2272 to the element 112 and has a tendency to pull the upper bracket 2272 to the unlatched position.

When not triggered, the upper bracket 2272 is still maintained in the latched position illustrated in FIG. 22A by lips 2276 present on the lower and upper brackets. However, when a vehicle traverses the upper plate deployable element 112 and weight impinges on the plate 112, the upper bracket 2272 is pushed downward, such that the lips on the lower and upper brackets clear each other, and the spring 2218 is able to pull the upper bracket 2272 to the right of FIG. 22A and up toward the element 112 so that the spring-loaded latch triggering device 2220 thus triggers the actuating spring 118 to move the plate 112 to the deployed orientation.

In some embodiments, an apparatus can include a communications module (not shown in FIG. 22A) that can receive a trigger communication causing a triggering device to provide the trigger to the actuating mechanism to deploy. This feature of being able to receive a trigger communication from a remote location to cause the trigger to be provided to the actuating mechanism can be in place of, or in addition to, features of the apparatus that allow for self-triggering by the apparatus itself detecting weight or momentum of the vehicle, etc. In one example, the apparatus 2200 may be modified for remote communication operation, where the spring 2218 is replaced by an actuator and the lips 2276 are not present on the lower and upper brackets 2270 and 2272, respectively. In this case, the apparatus 2200 need not itself respond to weight of an impinging vehicle for self-triggering operation. Instead of itself responding to the weight for self-triggering, the apparatus 2200, so modified, may receive the trigger communication from a remote location by the communications module not shown, cause the actuator (replacing the spring 2218) to pull the upper bracket 2272 to the unlatched position, and, thus, trigger the spring 118 to deploy the plate element 112. Furthermore, as described hereinafter in connection with FIG. 23, self triggering may by employed in a system that includes a remote vehicle sensor, such as a force sensor, that is not part of an embodiment apparatus itself. It should also be understood that self-actuation, as illustrated in FIG. 22A and in other embodiments in other drawings, may be combined with remote triggering functions in various embodiments that are not illustrated.

The apparatus 2200 also includes various handling adapters configured to be mechanically coupled to the base 110, either directly or indirectly, and configured to facilitate handling of the vehicle barrier apparatus 2200 by machinery. Forklift adapters 2277 are attached directly to the bottom of the base 110 for the apparatus 2200 to be lifted by a forklift. In general, handling adapters in various embodiments may be configured to be mechanically coupled to other parts of a given apparatus instead of the base. For example, the apparatus 2200 also includes a crane loop 2279 that is attached to the deployable element 112, facilitating picking up the apparatus 2200 by a crane attached to a truck, the crane having a hook to grab the crane loop, for example. Indirectly, the crane loop 2279 is also mechanically coupled to the base 110. The forklift adapters 2277 and the crane loop 2279 may be permanently affixed to the apparatus 2200, or they may be attached via a bolt coupling that is configured to mate with the crane loop or the forklift handling adapters. It will be understood that, in other embodiments, many adaptations may be made to various embodiments to facilitate handling by a forklift, crane, cart, winch, or any other machinery, in addition to handles and other accessories that can enable handling by humans.

Figure 22B:
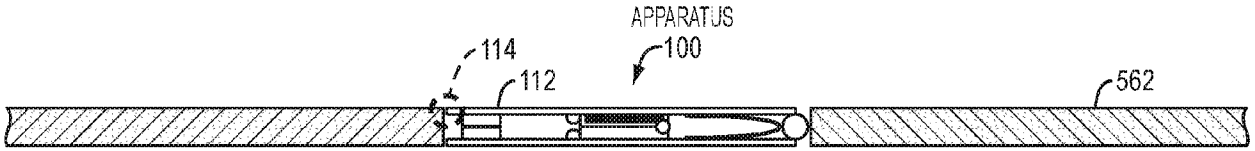
FIG. 22B is a profile-view of the apparatus of FIGS. 2A-2C installed below the pavement surface in a street or sidewalk.

FIG. 22B is a profile-view of the apparatus 100 installed below the pavement surface 562 in a street or sidewalk. In this configuration, it will be understood that the deployable element plate 112 will be below, or level with, the surface 562 of the street or sidewalk in the stored orientation, whereas the vehicle engagement end 114 will be above the surface 562 in the deployed orientation. In the configuration illustrated in FIG. 22B, the installation of the apparatus 100 may be permanent or temporary. Furthermore, where the apparatus 100 is installed below the surface 562 only temporarily, a filler block may be placed in the space for normal driving conditions (where no protection is desired) when the apparatus 100 is removed.

Figure 22C:
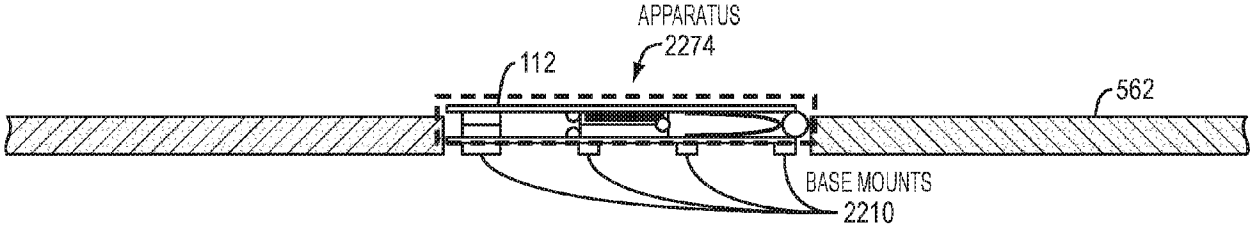
FIG. 22C is a profile-view illustration of an embodiment apparatus that is mounted to the ground without a base.

FIG. 22C is a profile-view illustration of an apparatus 2274 that is similar in some respects to the apparatus 100 illustrated in FIG. 2A. However, the apparatus 2274 does not include the base 110. Instead, base mounting points 2210 are provided in the ground, such that the apparatus 2274 may be connected thereto at various points for securing the apparatus 2272 to a surface. A communications module (described hereinafter in connection with FIG. 22C), may be provided as part of the apparatus 2274 to respond to a remote trigger communication triggering the apparatus 2274 to provide the trigger to the actuating mechanism to move to the deployed orientation.

The apparatus 2274, like other embodiments described herein, may be part of a system that includes self-triggering via any means described herein. These means can include a force sensor installed within the apparatus 2274 or external to the apparatus 2274, such as in or on the pavement surface 562. Accordingly, a force sensor installed in the pavement 562, separate from the apparatus 2274, may sense that a vehicle is approaching, and the force sensor may communicate to the apparatus 2274 a triggering communication, causing the apparatus to deploy.

Figure 23:
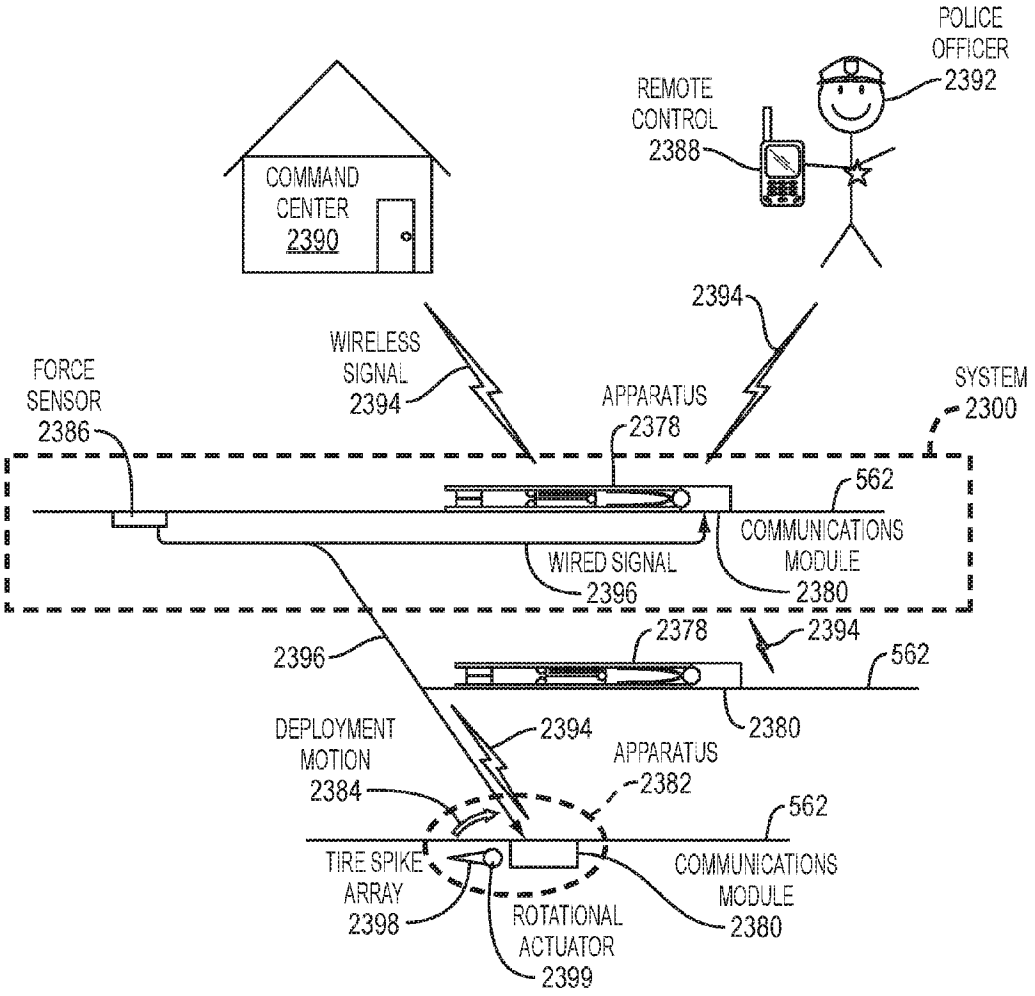
FIG. 23 is a schematic diagram illustrating how various embodiments may interact with an environment surrounding the embodiments to provide self-actuated deployment or remotely-activated deployment of a vehicle barrier apparatus or system.

FIG. 23 is a schematic diagram illustrating how various embodiments may interact with an environment surrounding the embodiments to provide self-actuated deployment, remotely-activated deployment, or both, of a vehicle barrier apparatus or system. In one aspect of FIG. 23, a system 2300 is configured for self-triggered actuation. The system 2300 includes an apparatus 2378, which in turn includes both the apparatus 100 illustrated in FIG. 2A, as well as a communications module 2380 that is capable of both wired and wireless communications. The system 2300 also includes a force sensor 2386 that is installed under the paved street or sidewalk 562. In other embodiments, the force sensor 2386 may be installed above ground in the form of a pad-based or plate-based force sensor that can sense the weight of a vehicle. The force sensor 2386 is configured to send a wired signal 2396 to the communications module 2380, causing the triggering device in the apparatus 2378 to trigger the actuating mechanism to deploy the deployable element. In this aspect, the system 2300 may be self-contained and self-triggered to protect a venue.

In another aspect, in addition to, or in contrast to the wired communications shown, the apparatus 2378 may also communicate to or from other remote locations besides the force sensor 2386 that, like the force sensor 2386, are not mechanically connected to the apparatus 2378. For example, the apparatus 2378 can communicate via wireless signals 2394 to and from a command center 2390 and a remote control 2388 that is held by a police (or other security) officer 2392. The police officer 2392, or someone at the command center 2390, may notice that a vehicle poses a threat and send a wireless signal 2394 to the apparatus 2378 to trigger it to deploy.

It should be understood that communications to and from the command center, remote control 2388, and for sensor 2386 may be wired or wireless, consistent with various embodiments. Moreover, a single command, or separate command, from the command center, remote control 2388, or other remote location may control multiple embodiments, including the separate apparatus 2378 illustrated in FIG. 23.

In another aspect, FIG. 23 illustrates an apparatus 2382 that includes a traditional tire spike array 2398 (shown in profile view, installed under the pavement 562) that is configured to be rotationally actuated by an actuator 2399 to move, via a deployment motion 2384, such that the tire spike array 2398 points above the ground and can penetrate vehicle tires. In addition, the embodiment apparatus 2382 also includes a communications module 2380 that can receive a remote communication from the force sensor 2386 for triggering deployment of the spikes. However, as illustrated, the apparatus 2382 may also communicate via wireless communications 2394 to other remote locations, such as the command center 2390 or the remote control 2388. Furthermore, via the wireless communications 2394, or via wired communications, the communications module 2380 (also referred to as a communications interface herein) may be configured to transmit a status indicator including a state of the deployable element. The status may include whether the embodiment apparatus is in the stored state or in the deployed state, as well as other function indicators. Furthermore, the communications module 2380, in any one of the embodiments described herein, may receive a disable communication causing triggering of the embodiment apparatus to be disabled and preventing deployment.

It will be understood that the tire spike array 2398 may have a permanent vertical orientation, such that the tire spike array 2398 is pointed up when below the pavement 562 (in the stored orientation), as well as when pointed up above the pavement surface 562 (in the deployed orientation). Furthermore, while not shown in FIG. 23, an alternative system within the scope of embodiments disclosed herein can include the force sensor 2386, together with the apparatus 2382, whether with the rotational actuator 2399, or modified to include a translational actuator to actuate vertical oriented spikes from below the ground to above the ground as described herein above. In this way, consistent with embodiments described herein, a tire spike array can be coupled to a force sensor or other vehicle detector to form a self-deploying vehicle barrier system. In order to allow passage of emergency vehicles or other authorized vehicles, they may be equipped with a transponder device that can be read or detected by an embodiment apparatus or system having an appropriate reader, and deployment of a deployable element may then be disabled by any of the means described herein.

Figure 24A:
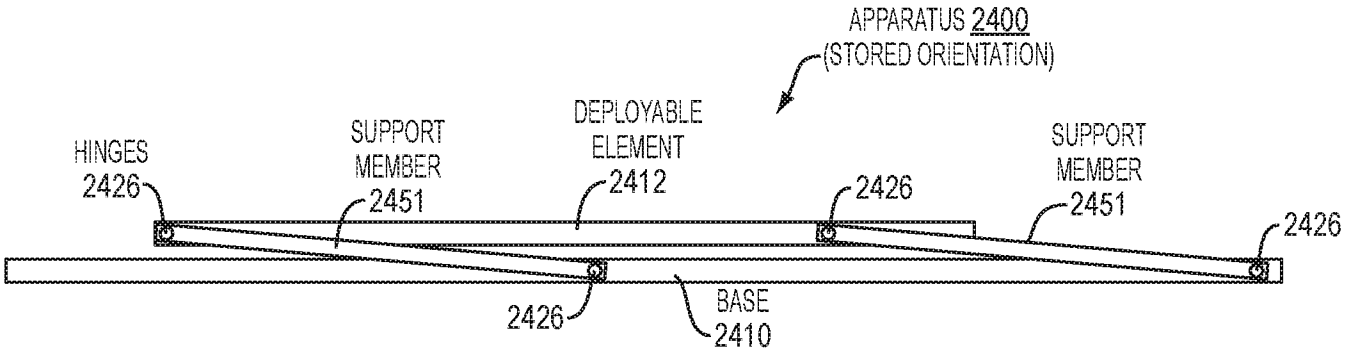
FIG. 24A is a profile-view illustration of a stored orientation of an embodiment apparatus having a deployable element without a base end.
Figure 24B:
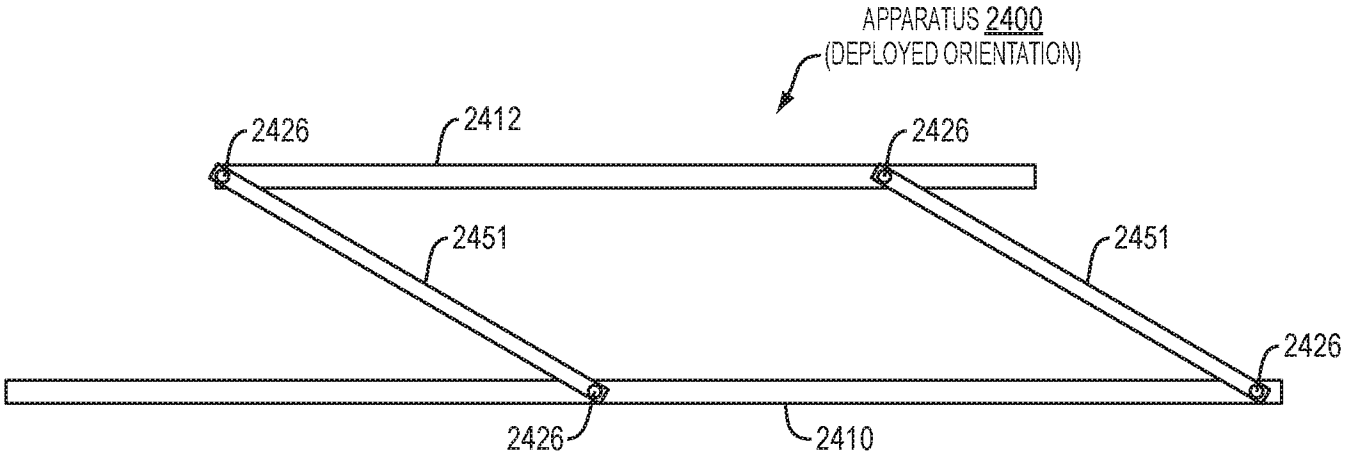
FIG. 24B is a profile-view illustration of a deployed orientations of the apparatus of FIG. 24A.

FIGS. 24A-24B are profile-view illustrations of an apparatus 2400 in stored and deployed orientations, respectively. The apparatus 2400 illustrates one way in which an embodiment apparatus may have a deployable element that is rotatably coupled to a base by means other than a base end of the deployable element. The apparatus 2400 includes a base 2410 and a deployable element 2412, both of which have plate-type configurations similar to those of the apparatus 100 illustrated in FIGS. 2A-2C. However, in the apparatus 2400, the deployable element 2412 is rotatably coupled to the base 2410 by means of two support members 2451. Each of the support members is rotatably coupled to the base 2410 and to the deployable element 2412 by means of hinges 2426. In both the stored and deployed configurations, the base 2410 and deployable element 2412 remain substantially parallel to each other. In the deployed orientation illustrated in FIG. 24B, in contrast to the stored orientation in FIG. 24A, the deployable element plate 2412 is raised, such that it can engage with an oncoming vehicle.

Like the embodiment illustrated in FIG. 3, the apparatus 2400 may include a tire spike at an end of the deployable element 2412. Because FIGS. 24A-24B are intended only to show orientation of the deployable element and base with respect to each other, as well as the support members that rotatably couple the two together, no actuating mechanism, triggering device, or communications interface is illustrated in these figures. However, it should be understood that the apparatus 2400 may include any of these features, as well as other modifications and features that are described throughout the specification and illustrated in the various drawings, as appropriate. Furthermore, it will be understood that the apparatus 2400, as well as other embodiments described throughout the specification, may be modified to include any of the features described in the various embodiments, as will be understood by those skilled in the mechanical arts in view of this specification.

Figure 25A:
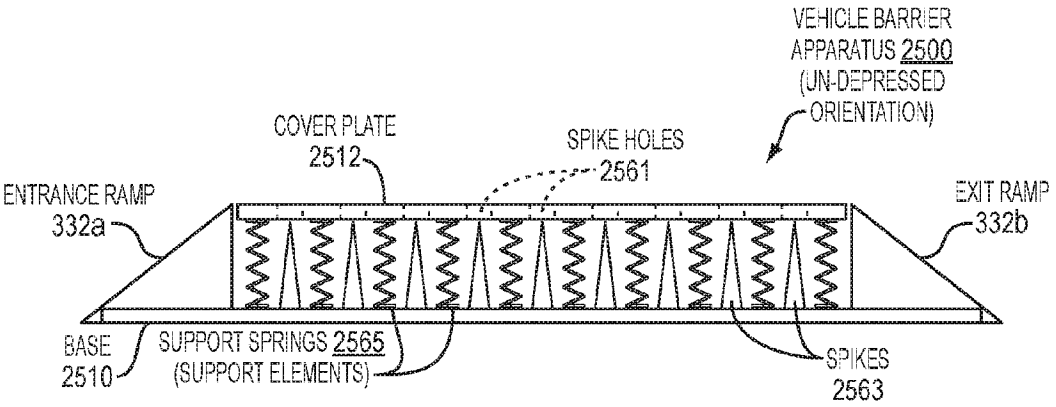
FIGS. 25A-25B are profile-view illustrations of a spring- and cover plate-base vehicle barrier apparatus in un-depressed and depressed orientations, respectively.

FIG. 25A is a profile-view illustration of a vehicle barrier apparatus 2500 in and un-depressed orientation. The apparatus 2500 includes a base 2510, and the base has various tire spikes 2563 extending therefrom, which are configured to puncture vehicle tires when the cover plate 2512 becomes depressed. The cover plate 2512 includes various spike holes 2561 that are configured to permit at least partial passage of at least certain ones of the tire spikes 2563 there through when the cover plate 2512 is depressed by a car impinging thereon. Supporting the cover plate are various support springs 2565 (also referred to herein as support elements). The springs fully support the cover plate 2512 in the un-depressed orientation when a vehicle is not impinging on the cover plate 2512, such that the tire spikes do not extend through the spike holes. The apparatus 2500 also includes the entrance ramp 332*a* and exit ramp 332*b*, similar to those illustrated in FIG. 3.

Figure 25B:
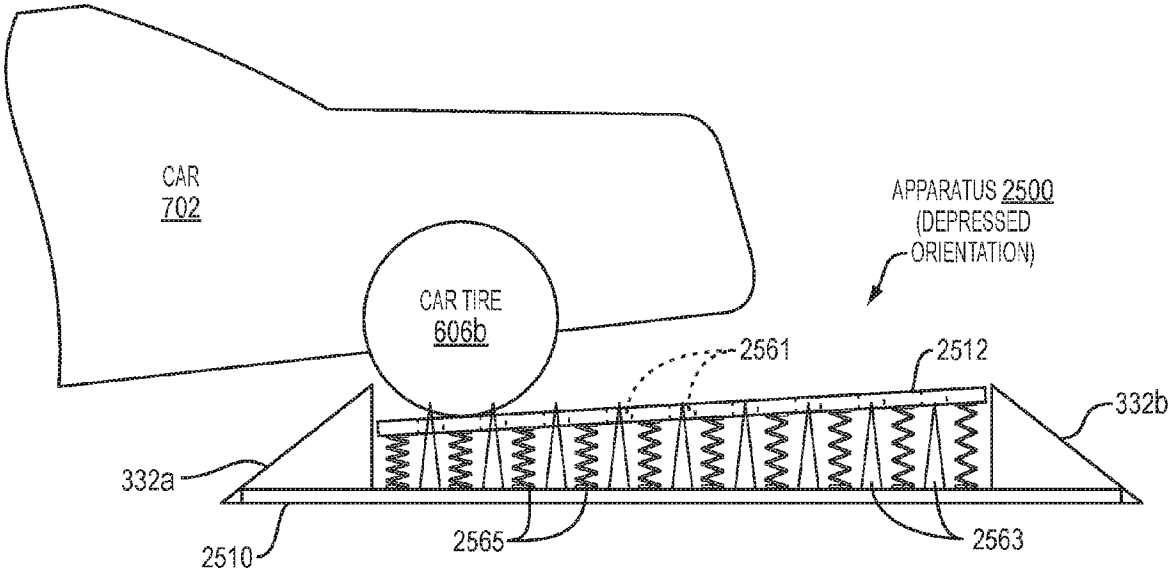

FIG. 25B is a profile-view illustration of the vehicle barrier apparatus 2500 shown in FIG. 25A, except that it is in a depressed orientation due to the car 702 impinging thereon. The car 702 drives up the entrance ramp 332*a* and then onto the cover plate 2512. With the car on the cover plate, the support springs 2565 can no longer support the weight, causing the cover plate 2512 to be lowered ("depressed") and allowing at least some of the spikes 2563 to extend at least partially through respective spike holes 2561. The spike can then puncture the car tire 606*b* to impair motion of the car 702.

Advantageously, the springs 2565 can be configured to allow passage of pedestrians and light objects over the cover plate 2512, while allowing the cover plate to be depressed in response to the weight of a car or truck. Furthermore, it is possible to select springs such that passage of a small car over the apparatus 2500 may be allowed, yet a large truck impinging on the cover plate 2512 will cause the cover plates to fall to the depressed orientation, and the truck will be disabled.

Furthermore, in other embodiments not shown, the entrance and exit ramps are not required, and a similar apparatus may be installed under the pavement, such that the cover plate 2512 is even with the pavement in the un-depressed orientation. Moreover, it should be understood that other support elements besides support springs may be used. For example, the cover plate 2512 may be modified in other embodiments such that it is supported, in the un-depressed orientation, only by shear pins similar to those described in connection with other embodiments. For example, the shear pins may couple the entrance and exit ramps to the cover plate via hinges, similar to the entrance ramp and shear pin in the embodiment of FIGS. 10A-10B. The shear pins may be selected such that they will allow passage of persons and small objects over the cover plate, yet shear or break in response to a vehicle impinging thereon. Furthermore, as will be understood in view of other embodiments described herein, a variety of different latch mechanisms may be used, such that an apparatus similar to the apparatus 2500 may collapse to a depressed orientation in response to a heavy vehicle impinging thereon.

Moreover, in other embodiments not shown, a vehicle barrier apparatus can includes tire spikes and a cover plate such as those illustrated in FIGS. 25A-25B. However, there are no springs or shear pins, and the spikes are actuated to pass through the spike holes by electromechanical, pneumatic, motorized, or other means in response to detection of a vehicle. Using principles similar to those described throughout the specification, the spikes can be used as a type of deployable element with respective base ends and vehicle engagement ends, with the vehicle engagement ends being the pointed tips of respective spikes. An actuating mechanism may be mechanically coupled to the spikes individually, or to a base supporting the spikes, to cause the deployable element spikes to be thrust upward from a stored orientation, underneath the cover plate, to a deployed orientation, with the spikes extending at least partly through the cover plate. The actuating mechanism may cause this deployment in response to a trigger, and a triggering device may be operably coupled to the actuating mechanism and configured to detect a presence of the vehicle and to provide the trigger to the actuating mechanism responsive to detecting the presence of the vehicle. Such an apparatus may be part of the system similar to the systems described in connection with FIG. 23, which can respond to a wireless signal for triggering, or respond to a force sensor that is part of the apparatus or is part of a system and is remote from the apparatus.

It should be understood that any of the embodiments described herein may include a communications module as described herein, for the purposes described herein as well as any other purpose known to those skilled in the art, or which may be apparent to those skilled in the art based on the disclosure herein.

While example embodiments have been particularly shown and described, it will be understood by those skilled in the art that various changes in form and details may be made therein without departing from the scope of the embodiments encompassed by the appended claims.

What is claimed is:

1. A vehicle barrier apparatus comprising:

a base;

a deployable element rotatably coupled to the base to enable a transition from a stored orientation to a deployed orientation, the deployable element being configured in the deployed orientation to engage a vehicle physically to impair motion of the vehicle;

an actuating mechanism mechanically coupled to the deployable element and configured to cause the deployable element to move from the stored orientation to the deployed orientation in response to a trigger; and a triggering device including a shearing mechanism configured to detect a presence of the vehicle, the triggering device operably coupled to the actuating mechanism and configured to provide the trigger to the actuating mechanism responsive to the shearing mechanism's detecting the presence of the vehicle.

2. The apparatus of claim 1, wherein the deployable element has a base end and a vehicle engagement end, the deployable element being rotatably coupled to the base at the base end, and the vehicle engagement end being configured in the deployed orientation to engage the vehicle physically to impair motion of the vehicle, and wherein the actuating mechanism is configured to cause the deployable element to rotate from the stored orientation to the deployed orientation.

3. The apparatus of claim 2, wherein the deployable element has a continuous face spanning an entirety of lateral dimensions from the base end to the vehicle interface end.

4. The apparatus of claim 2, wherein the deployable element includes one or more struts, wherein, in the case of more than one strut, the struts:

i) have a common axis of rotation and a common direction of rotation;

ii) have at least two axes of rotation and at least two corresponding directions of rotation; or iii) have at least two axes of rotation and at least two corresponding directions of rotation, and wherein struts with a first axis of the axes of rotation are arranged to be interdigitated with struts with a second axis of the axes of rotation.

5. The apparatus of claim 2, wherein the vehicle engagement end of the deployable element includes one or more pointed tips configured to puncture one or more tires of the vehicle, with the deployable element in the deployed orientation, to impair the motion of the vehicle.

6. The apparatus of claim 2, wherein a rotation of the deployable element with respect to the base is limited by a cable to stop rotation of the deployable element at the deployed orientation, wherein the cable is attached to the base and to the deployable element either at the vehicle engagement end or between the base end and the vehicle engagement end.

7. The apparatus of claim 2, wherein the actuating mechanism includes a rocker configured to rotate the deployable element from the stored orientation to the deployed orientation using at least one of a weight and a momentum of the vehicle.

8. The apparatus of claim 2, wherein the base and the triggering device are the same, the actuating mechanism being a rocker rib configured to support the deployable element mechanically and to rotate the deployable element from the stored orientation to the deployed orientation responsive to a tire or wheel of the vehicle contacting the base and triggering device.

9. The apparatus of claim 1, wherein the base includes one or more ramps configured to facilitate a smooth transition of travel for the vehicle onto or off of the vehicle barrier apparatus with the deployable element in the stored orientation.

10. The apparatus of claim 1, wherein the apparatus is a first vehicle barrier apparatus, and wherein the base includes one or more interlocking elements configured to attach the base of the first vehicle barrier apparatus to one or more corresponding bases of one or more respective second vehicle barrier apparatuses.

11. The apparatus of claim 1, wherein the deployable element is further configured to impair motion of the vehicle by mechanically coupling the vehicle to the base, wherein the base has friction with the ground.

12. The apparatus of claim 1, wherein deployable element is configured to be below a surface of a street or sidewalk in the stored orientation, and wherein the vehicle engagement end is configured to be above the surface in the deployed orientation.

13. The apparatus of claim 1, wherein the deployable element and the base are coupled to respective portions of one or more brackets, and wherein the one or more brackets are configured to be folded while the deployable element is in the stored orientation, and wherein the one or more brackets are configured to be unfolded and locked when the deployable element is in the deployed orientation.

14. The apparatus of claim 1, wherein the actuating mechanism includes one or more springs configured to cause the deployable element to rotate or otherwise move from the stored orientation to the deployed orientation using stored spring power.

15. The apparatus of claim 1, wherein the actuating mechanism is configured to cause the deployable element to rotate or otherwise move from the stored orientation to the deployed orientation within about 10-100 ms.

16. The apparatus of claim 1, wherein the triggering device further includes at least one latch configured to provide the trigger in response to at least one of a weight and momentum of the vehicle.

17. The apparatus of claim 1, wherein the shearing mechanism includes one or more shear pins or shear belts configured to be sheared in response to at least one of a weight and momentum of the vehicle.

18. The apparatus of claim 1, wherein the triggering device is configured to discriminate between vehicles and other objects or persons to provide the trigger to the actuating mechanism responsive to detecting the presence of the vehicle but not responsive to detecting a presence of the other objects or persons.

19. The apparatus of claim 1, wherein the triggering device is further configured to discriminate on the basis of vehicle size by providing the trigger responsive to detecting the presence of a relatively larger vehicle and to not provide the trigger responsive to detecting the presence of a relatively smaller vehicle.

20. The apparatus of claim 1, further including a deactivating mechanism configured to prevent at least one of: the triggering device from providing the trigger, the actuating mechanism from responding to the trigger, and the deployable element from deploying.

21. The apparatus of claim 1, further including a manual activating mechanism configured to enable the deployable element to be set to the deployed orientation in response to a manual setting.

22. A vehicle barrier apparatus comprising:

a portable base;

a deployable element rotatably coupled to the base to enable a transition from a stored orientation to a deployed orientation, the deployable element being configured in the deployed orientation to engage a vehicle physically to impair motion of the vehicle;

an actuating mechanism mechanically coupled to the deployable element and configured to cause the deployable element to move from the stored orientation to the deployed orientation; and a shearing mechanism configured to detect a presence of the vehicle, the shearing mechanism operably coupled to the actuating mechanism and configured to trigger the actuating mechanism, responsive to the shearing mechanism's detecting the presence of the vehicle, to move from the stored orientation to the deployed orientation.

23. The apparatus of claim 22, wherein the deployable element includes a base end and a vehicle engagement end, the deployable element being rotatably coupled to the base at the base end, and the vehicle engagement end being configured in the deployed orientation to engage the vehicle physically to impair motion of the vehicle, and wherein the actuating mechanism is configured to cause the deployable element to rotate from the stored orientation to the deployed orientation.

24. The apparatus of claim 23, wherein the deployable element has a continuous face spanning an entirety of lateral dimensions from the base end to the vehicle interface end.

25. The apparatus of claim 23, wherein the deployable element includes one or more struts, wherein, in the case of more than one strut, the struts:

i) have a common axis of rotation and a common direction of rotation; or ii) have at least two axes of rotation and at least two corresponding directions of rotation; or iii) have at least two axes of rotation and at least two corresponding directions of rotation, and wherein struts with a first axis of the axes of rotation are arranged to be interdigitated with struts with a second axis of the axes of rotation.

26. The apparatus of claim 22, wherein the deployable element is further configured to impair motion of the vehicle by mechanically coupling the vehicle to the base, wherein the base has friction with the ground.

27. The apparatus of claim 22, wherein the deployable element and the base are coupled to respective portions of one or more brackets, and wherein the one or more brackets are configured to be folded while the deployable element is in the stored orientation, and wherein the one or more brackets are configured to be unfolded and locked when the deployable element is in the deployed orientation.

28. The apparatus of claim 22, wherein the actuating mechanism includes one or more springs configured to cause the deployable element to rotate or otherwise move from the stored orientation to the deployed orientation using stored spring power.

29. The apparatus of claim 22, wherein the actuating mechanism is configured to cause the deployable element to rotate or otherwise move from the stored orientation to the deployed orientation within about 10-100 ms.

30. The apparatus of claim 22, wherein the triggering device further includes at least one latch configured to provide the trigger in response to at least one of weight and momentum of the vehicle.

31. The apparatus of claim 22, wherein the shearing mechanism includes one or more shear pins configured to be sheared in response to at least one of weight and momentum of the vehicle.

32. The apparatus of claim 22, wherein the triggering device includes a force sensor.

33. The apparatus of claim 22, wherein the triggering device is configured to discriminate between vehicles and other objects or persons to provide the trigger to the actuating mechanism responsive to detecting the presence of the vehicle but not responsive to detecting a presence of the other objects or persons.

34. The apparatus of claim 22, wherein the triggering device is further configured to discriminate on the basis of vehicle size by providing the trigger responsive to detecting the presence of a relatively larger vehicle and to not provide the trigger responsive to detecting the presence of a relatively smaller vehicle.

35. The apparatus of claim 22, wherein the base and triggering device comprise the same element, the actuating mechanism is a rocker rib configured to mechanically support the deployable element and to rotate the deployable element from the stored orientation to the deployed orientation responsive to a tire or wheel of the vehicle contacting the base and triggering device.

36. The apparatus of claim 22, further including a deactivating mechanism configured to prevent at least one of: the triggering device from providing the trigger, the actuating mechanism from responding to the trigger, and the deployable element from deploying.

37. The apparatus of claim 22, further including a manual activating mechanism configured to enable the deployable element to be set to the deployed orientation in response to a manual setting.

38. The apparatus of claim 22, further comprising a communications interface operably coupled to the triggering device or actuating mechanism to disable triggering or otherwise prevent deployment of the deployable element.

* * * * *